US005697013A

United States Patent [19]

Sasaki

[11] Patent Number: 5,697,013

[45] Date of Patent: Dec. 9, 1997

[54] IMAGE FORMING APPARATUS FOR FORMING IMAGES IN ACCORDANCE WITH AN ELECTROPHOTOGRAPHIC PROCESS

[75] Inventor: Sachio Sasaki, Kawasaki, Japan

[73] Assignee: Fujitsu Limited, Kawasaki, Japan

[21] Appl. No.: 545,036

[22] Filed: Oct. 19, 1995

[30] Foreign Application Priority Data

Feb. 24, 1995 [JP] Japan ..... 7-037326

[51] Int. Cl.[6] ..... G03G 15/00

[52] U.S. Cl. ..... 399/55; 399/150

[58] Field of Search ..... 355/269, 246, 355/265; 399/149, 150, 53, 55; 361/214

[56] References Cited

U.S. PATENT DOCUMENTS

| | | | |
|---|---|---|---|
| 4,319,544 | 3/1982 | Weber | 399/55 |
| 4,769,676 | 9/1988 | Mukai et al. | 355/269 |
| 4,843,424 | 6/1989 | Oda et al. | 355/269 X |
| 5,036,369 | 7/1991 | Toda et al. | 355/269 X |
| 5,541,717 | 7/1996 | Saito et al. | 355/269 |

FOREIGN PATENT DOCUMENTS

| | | |
|---|---|---|
| 7-114319 | 5/1995 | Japan . |
| 7-129035 | 5/1995 | Japan . |

*Primary Examiner*—Arthur T. Grimley
*Assistant Examiner*—Sophia S. Chen
*Attorney, Agent, or Firm*—Armstrong, Westerman, Hattori, McLeland & Naughton

[57] ABSTRACT

An image forming apparatus performs an electrophotographic process including a uniform charging step, an exposure step, a developing step and a transfer step on a photosensitive drum which is driven so that an image is formed on a recording medium. The image forming apparatus includes a discharging unit for discharging the photosensitive drum which has been uniformly charged, a discharging control unit for controlling said discharging unit before the photosensitive drum is stopped so that a potential distribution is obtained in an area having a predetermined width starting from a position at which said discharging unit starts to discharge said photosensitive drum, the potential distribution being between a first potential obtained by charging said photosensitive drum and a second potential, a stop control unit for performing an operation for stopping driving said photosensitive drum in a state where a developing position enters the area having the potential distribution, and a bias control unit for turning off a developing bias used in the developing step in the state where the developing position enters the area having the potential distribution.

30 Claims, 24 Drawing Sheets

T1 : TIME NEEDED TO STABILIZE ROTATION OF MOTOR AND TO STOP MOTOR

T2 : TIME NEEDED TO MOVE CHARGED PORTION TO EXPOSURE POSITION

T3 : TIME NEEDED TO MOVE A POINT ON PHOTOSENSITIVE DRUM FROM EXPOSURE POSITION TO DEVELOPING POSITION

T5 : TIME CORRESPONDING TO DEVELOPING-NIP WIDTH (120ms. NIP WIDTH: 3mm)

T1 : TIME NEEDED TO STABILIZE ROTATION OF MOTOR

T2 : TIME NEEDED TO MOVE CHARGED PORTION TO EXPOSURE POSITION

T3 : TIME NEEDED TO MOVE A POINT ON PHOTOSENSITIVE DRUM FROM EXPOSURE POSITION TO DEVELOPING POSITION

T4 : TIME NEEDED TO STOP MOTOR

T1 : TIME NEEDED TO STABILIZE ROTATION OF MOTOR AND TO STOP MOTOR

T2 : TIME NEEDED TO MOVE CHARGED PORTION TO EXPOSURE POSITION

T3 : TIME NEEDED TO MOVE A POINT ON PHOTOSENSITIVE DRUM FROM EXPOSURE POSITION TO DEVELOPING POSITION

T5 : TIME CORRESPONDING TO DEVELOPING-NIP WIDTH (120 ms. NIP WIDTH: 3 mm)

FIG. 11

| | | |
|---|---|---|
| | | NOTE |
| CONVENTIONAL APPARATUS | X X | STRONGLY SOILED |
| APPARATUS OF 1 st EMBODIMENT | O | NOT SOILED |

T1 : TIME NEEDED TO STABILIZE ROTATION OF MOTOR AND TO STOP MOTOR

T2 : TIME NEEDED TO MOVE CHARGED PORTION TO EXPOSURE POSITION

T3 : TIME NEEDED TO MOVE A POINT ON PHOTOSENSITIVE DRUM FROM EXPOSURE POSITION TO DEVELOPING POSITION

T5 : TIME CORRESPONDING TO DEVELOPING-NIP WIDTH (120ms. NIP WIDTH : 3mm )

T1 : TIME NEEDED TO STABILIZE ROTATION OF MOTOR AND TO STOP MOTOR

T2 : TIME NEEDED TO MOVE CHARGED PORTION TO EXPOSURE POSITION

T3 : TIME NEEDED TO MOVE A POINT ON PHOTOSENSITIVE DRUM FROM EXPOSURE POSITION TO DEVELOPING POSITION

T5 : TIME CORRESPONDING TO DEVELOPING-NIP WIDTH (120ms. NIP WIDTH : 3mm)

FIG. 18

■ or □ CORESPONDS TO A DOT

| PERIOD IN OPERATION SEQUENCE | DOT AREA MODULATION PATTERN | NOTE |
|---|---|---|
| A | ■■<br>■■ | ENTIER EXPOSURE |
| B | □■<br>■□ | |
| C | □□□<br>□□□<br>■□□ | |
| D | □□<br>□□ | NON-EXPOSURE |

FIG. 19

| | RESULTS (IN SEVEN APPARATUS) | | | | | | | NOTE |
|---|---|---|---|---|---|---|---|---|
| | #1 | #2 | #3 | #4 | #5 | #6 | #7 | |
| CONVENTIONAL APPARATUS | O△ | O△ | O△ | O△ | O△ | O△ | O△ | SOILED |
| APPARATUS OF 2nd EMBODIMENT | O | O | O | O | O | O | O | NOT SOILED |

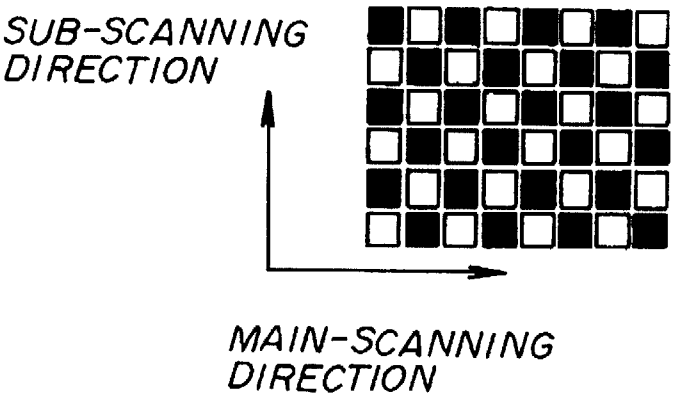
FIG. 20A
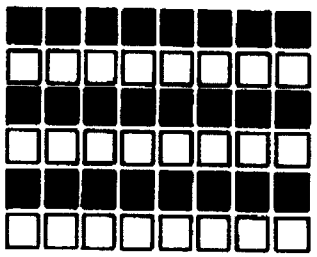
FIG. 20B
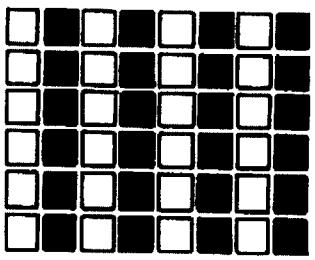
FIG. 20C
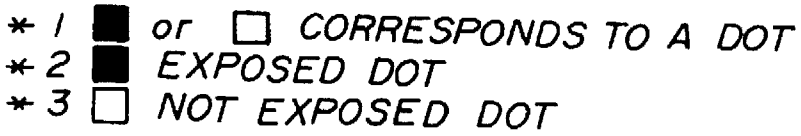

T1 : TIME NEEDED TO STABILIZE ROTATION OF MOTOR AND TO STOP MOTOR

T2 : TIME NEEDED TO MOVE CHARGED PORTION TO EXPOSURE POSITION

T3 : TIME NEEDED TO MOVE A POINT ON PHOTOSENSITIVE DRUM FROM EXPOSURE POSITION TO DEVELOPING POSITION

T4 : TIME NEEDED TO STOP MOTOR

T5 : TIME CORRESPONDING TO DEVELOPING-NIP WIDTH (120ms. NIP WIDTH: 3mm)

IMAGE FORMING APPARATUS FOR FORMING IMAGES IN ACCORDANCE WITH AN ELECTROPHOTOGRAPHIC PROCESS

BACKGROUND OF THE INVENTION (1) Field of the Invention

The present invention generally relates to an image forming apparatus, such as a printer and a copy machine, for forming images in accordance with an electrophotographic process, and more particularly to an image forming apparatus which can form images in accordance with the electrophotographic process even if a cleaner removing residual developer on a photosensitive body after a transfer step is not used.

(2) Description of the Related Art

In recent years, in an image forming apparatus forming images in accordance with an electrophotographic process (hereinafter, such apparatus is referred to as an electrophotographic apparatus), a type having no cleaner unit for removing residual toner on a photosensitive drum after a transfer step (hereinafter, referred to as a cleanerless type) has been proposed in order to reduce a production cost and to miniaturize. The cleanerless type electrophotographic apparatus has the following advantages:

(1) a mechanism for dumping toner is not needed;

(2) a space in which toner to be dumped is stored is not needed;

(3) all toner is used to form images so as to be economical; and (4) there is no toner to be dumped so that environmental problems do not occur.

An example of the cleanerless type electrophotographic apparatus is shown in FIG. 1.

Referring to FIG. 1, a charger unit 2, an optical unit 3, a developing unit 4 and a transfer unit 5 are arranged around a photosensitive drum 1 so that the electrophotographic process is performed on the photosensitive drum 1. A fixer unit 8 is arranged in a path through which a recording paper is fed after an image is formed. A scattering roller 9 is provided between the transfer unit 5 and the charger unit 2 so as to be in contact with the photosensitive drum 1.

In the electrophotographic apparatus having the above structure, the charger unit 2 uniformly charges the surface of the photosensitive drum 1 which is rotated. The optical unit 3 then exposes, in accordance with image data representing an image pattern, the photosensitive drum 1 which has been uniformly charged. Potential values (absolute values) of areas on the photosensitive drum 1 which are exposed by the optical unit 3 are decreased so that an electrostatic latent image is formed on the photosensitive drum 1. The electrostatic latent image is then developed by the developing unit 4. That is, while the electrostatic latent image formed on the rotated photosensitive drum 1 is passing through a developing position at which the developing unit 4 faces the photosensitive drum 1, toner charged in the developing unit 4 adheres to the electrostatic latent image so that a toner image corresponding to the electrostatic latent image is formed on the photosensitive drum 1. A sheet P is fed to a transfer position at which the transfer unit 5 faces the photosensitive drum 1. The transfer unit 5 charges the sheet P at a polarity opposite to that of the toner so that the toner image is electrostatically transferred from the photosensitive drum 1 to the sheet P. When the sheet P on which the toner image is formed passes though the fixer unit 8, the toner image is fixed on the sheet P by heat and pressure supplied by the fixer unit 8.

After the toner image is transferred to the sheet P, a slight amount of toner remains on the photosensitive drum 1 (residual toner). The residual toner is scattered by the scattering roller 9 so as to be uniformly distributed on the photosensitive drum 1. After this, in this state, a charging step for uniformly charging the photosensitive drum 1 and an exposing step for exposing the photosensitive drum 1 which has been charged are successively performed. The developing unit 4 develops an electrostatic latent image while collecting the residual toner.

A detailed description will now be given of the developing step in the electrophotographic process.

The charger unit 2 uniformly charges the photosensitive drum 1 so that a surface potential of the photosensitive drum 1 is set within a range between −500 volts and −1000 volts. In the exposure step, the potential of exposed areas on the photosensitive drum 1 which has been charged is reduced to a range between −50 volts and −100 volts so that the electrostatic latent image is formed. In the developing step, a developing bias (e.g., −400 volts) set between the surface potential and the potential of the exposed areas (in the electrostatic latent image ) is applied to a developing roller of the developing unit 4. The toner adhering to the developing roller is charged at a minus potential. Due to an electric field formed by the difference between the developing bias and the potential of the electrostatic latent image, the charged toner adheres to the electrostatic latent image so that the toner image is formed on the photosensitive drum 1. While the electrostatic latent image is being developed, due to an electric field formed by the difference between the surface potential and the developing bias, the residual toner which has been uniformly distributed on the photosensitive drum 1 by the scattering roller 9 is collected by the developing unit 4 (in a case where magnetic toner is used, magnetic force acts on the residual toner).

The distribution of the residual toner restrains the residual toner from functioning as a filter in the exposure step. In addition, due to the distribution of the residual toner, an amount of residual toner to a unit area is reduced so that it is easy for the developing unit to collect the residual toner.

Further, the scattering roller may have a function for discharging the photosensitive drum 1. In this case, a scattering voltage is applied to the scattering roller 9. Due to the scattering voltage, charges supplied to the photosensitive drum 1 in the transfer step are removed therefrom. Thus, the residual toner can be further efficiently collected by the developing unit 4.

In the cleanerless-type electrophotographic apparatus (printer or copy machine) miniaturized as has been described above, the photosensitive drum 1, the developing unit 4 and the scattering roller 9 are driven by a single motor. In addition, a uniformly charging voltage Vd, a transfer voltage Vt, the developing bias Vb and a scattering voltage Vc are generated by a high-voltage unit. Although the developing bias Vb can be independently on or off, the uniformly charging voltage Vd, the transfer voltage Vt and the scattering voltage Vc are simultaneously on or off.

In this case, after an image forming process is completed and after a power is turned on and an initial operation is then completed, the potential distribution on the photosensitive drum 1 is formed as shown in FIG. 1. That is, an area a between a position P1 at which the charger unit 2 uniformly charges and a position P3 facing the developing unit 4 is maintained at a predetermined potential, for example, −600 volts, generated by the charger unit 2. An area b between the position P3 and a position P4 facing the transfer unit 5 has almost the same potential as the surface potential generated by the charger unit 2. An area c between the position P4 and a position P5 at which the scattering roller 9 is in contact with the photosensitive drum 1 has a plus potential generated by the transfer unit 5. An area d between the position P5 and the position P1 is discharged to about 0 volts in a case where the scattering roller 9 has the function for discharging the photosensitive drum 1. On the other hand, in a case where the scattering roller 9 does not have the function for discharging the photosensitive drum 1, the area d may have a plus potential. However, when the area having the plus potential passes through the position P1, the area is charged at the minus potential by the charger unit 2.

In a case where the developing bias (e.g., –400 volts) is turned on immediately after the previous image process is completed or immediately after the initial operation is completed, since the area a is uniformly charged at the predetermined potential (e.g., –600 volts), the toner is not transferred from the developing unit 4 to the photosensitive drum 1. However, in a case where the electrophotographic apparatus is left as it is after the image process or the initial operation is completed, the potential of the area a is close to 0 volts (e.g., in a range between 0 volts and a few ten volts) caused by natural decrement of the potential. In this case, when the developing bias (e.g., –400 volts) is turned on to start forming images, due to the electrostatic field formed between the developing roller and the photosensitive drum 1, the toner charged at a minus potential adheres to the photosensitive drum 1.

To prevent the toner from adhering to the photosensitive drum 1 in the case where the electrophotographic apparatus is left as it is after the previous image forming process or the initial operation is completed, the developing bias could be maintained in an off state (0 volts) for a predetermined time from starting of the image forming process. However, in this case, if the developing unit 4 has two-component system developer (formed from toner and carrier), when the image forming process starts immediately after the previous image forming process or the initial operation is completed, the carrier charged at a plus potential adheres to the photosensitive drum 1 (the surface potential is –600 volts caused by the electrostatic field formed between the developing roller and the photosensitive drum 1).

The toner adhering to the photosensitive drum 1 as has been described above is scattered by the scattering roller 9 and is then collected by the developing unit 4. However, if an amount of the toner adhering to the photosensitive drum 1 is increased, the quality of the image formed on the sheet P is deteriorated. In addition, the carrier adhering the photosensitive drum 1 deteriorates the quality of the image formed on the sheet P.

Thus, to prevent the toner and the carrier from adhering to the photosensitive drum 1 after the previous image forming process and the initial operation are completed, the applicant has proposed an electrophotographic apparatus as disclosed in Japan Laid Open Patent Application No. 5-258703.

In this electrophotographic apparatus, before the image forming process starts, the optical unit 3 entirely exposes the area a so that the area a is discharged. After this, when a leading edge of an area on the photosensitive drum 1 which area has been uniformly charged reaches the position P3 facing the developing unit 4, the developing bias is turned on. An operation sequence is shown in FIG. 2.

Referring to FIG. 2, at a time ① before the image forming process starts, the motor is made to start to drive the photosensitive drum 1 and the developing unit 4. At this time, the optical unit 3 is activated to entirely expose the photosensitive drum 1 so that the surface potential of the photosensitive drum 1 is decreased.

At a time ② at which the motor has been in a stable state, the high voltages required for the process: the charging voltage Vd, the transfer voltage Vt and the scattering voltage Vc are simultaneously turned on.

At a time ③, a portion of the photosensitive drum 1 which is charged at a predetermined potential by the charger unit 2 reaches an exposure position (P2 in FIG. 1). At this time, the optical unit 3 stops entirely exposing the photosensitive drum 1. That is, after a time T2 elapses from the time ②, the optical unit 3 stops entirely exposing the photosensitive drum 1.

After a time T3 elapses from the time ③, the leading edge of an area of the photosensitive drum 1 which is not exposed reaches a developing position (the position P3 in FIG. 1). At this time ④, the developing bias Vb to be applied to the developing roller is turned on.

In a period ⑤ of time, the photosensitive drum 1 is being driven for a predetermined time from the time ④, and the optical unit 3 exposes the photosensitive drum 1 in accordance with printing data so that a printing operation is performed.

At a time ⑥, the optical unit 3 starts to entirely expose the photosensitive drum 1 before the photosensitive drum 1 stops in order to complete the image forming process.

After a time T3 from the time ⑥, the leading edged of an area which has been entirely exposed reaches the developing position (the position P3 in FIG. 1). At this time ⑦, the developing bias is turned off.

At a time ⑧, the motor, the charging voltage Vd, the transfer voltage Vt and the scattering voltage Vc are turned off. In addition, the optical unit 3 stops entirely exposing the photosensitive drum 1.

Although the above sequence is applied to the image forming process the sequence can be applied to the initial operation performed after the power supply is turned on or in a restart of the image forming process after a paper jam is removed.

According to the above operation sequence, the image forming process never starts in a state where the area a between the charger unit 2 and the developing unit 4 is charged by the charger unit 2. When the leading edge of the area on the photosensitive drum 1 which has been uniformly charged faces the developing unit 4, the developing bias is turned on. Thus, the toner and carrier are prevented from adhering to the photosensitive drum 1.

In a case where the developing bias and the entire exposure operation of the optical unit 3 are controlled in accordance with the sequence as has been described above, at the time ⑦ at which the developing bias is turned off and at the time ④ at which the developing bias is turned on, the developing roller faces potential boundary portions of the photosensitive drum 1. In each of the potential boundary portions, as shown in FIG. 3, the surface potential distribution is suddenly changed from a discharged potential (e.g., in the range between –50 volts and –100 volts) to the charged potential (e.g., –600 volts). The potential boundary portions correspond to the leading edge of the area entirely exposed by the optical unit 3 and the trailing edge of that. An area on which the developing roller and the photosensitive drum 1 are in contact with each other has a width in a direction in which the photosensitive drum 1 is rotated. The area is referred to as a developing-nip area. In a state where the potential boundary portion in which the surface potential distribution is suddenly changed is in the developing-nip area, both a portion (a non-exposed portion) having the charged potential and a portion (an exposed portion) having the discharged potential face the developing roller in the developing-nip area. When the developing bias is turned on in this state, the electrostatic field formed by the difference between the developing bias (−400 volts) and the discharged potential (−50 volts to −100 volts) causes the toner to adhere to the exposed portion having the discharged potential. In addition, when the developing bias is turned off on the above state, the electrostatic field formed by the difference between the potential of the developing roller and the charged potential (−600 volts) causes the carrier of the two-component developer to adhere to the non-exposed portion having the charged potential.

As a result, as shown in FIG. 4(A), when the photosensitive drum 1 stops and starts, the toner and the carrier adhere to the potential boundary portions corresponding to the leading edge (corresponding to the time ⑥) and the trailing edge of the area of the photosensitive drum 1 which has been entirely exposed. If the toner and the carrier adhering to the photosensitive drum 1 in a band-shaped condition are not sufficiently collected by the developing unit 4, the sheet P is soiled by the toner so that the quality of the image formed on the sheet P is deteriorated (see FIG. 4(B)). If a large amount of carrier adheres to the photosensitive drum 1, not only is the quality of the image formed on the sheet P deteriorated, but also the carrier is scattered in the housing so that the inside of the housing and sheets P are soiled with the carrier.

Furthermore, in a case where the width, in a direction perpendicular to the direction in which the photosensitive drum 1 is rotated, of the area which is entirely exposed is less than the width of a sheet P used in the apparatus, the developer (mainly the carrier) which adhered to side edge portions of the photosensitive drum 1 causes side edge portions of the sheet P to be soiled (see FIG. 4(A)).

SUMMARY OF THE INVENTION

Accordingly, a general object of the present invention is to provide a novel and useful image forming apparatus in which the disadvantages of the aforementioned prior art are eliminated.

A more specific object of the present invention is to provide an image forming apparatus in which an image formed on a sheet in accordance with an electrophotographic process is not soiled with developer.

The above objects of the present invention are achieved by an image forming apparatus in which an electrophotographic process including a uniform charging step, an exposure step, a developing step and a transfer step is performed on a photosensitive body which is driven so that an image is formed on a recording medium, the image forming apparatus comprising: discharging means for discharging the photosensitive body which has been uniformly charged; discharging control means for controlling the discharging means before the photosensitive body is stopped so that a potential distribution is obtained in an area having a predetermined width starting from a position at which the discharging means starts to discharge the photosensitive body, the potential distribution being between a first potential obtained by charging the photosensitive body and a second potential; stop control means for performing an operation for stopping driving the photosensitive body in a state where a developing position enters the area having the potential distribution, the developing position being a position at which the developing step is performed on the photosensitive body; and bias control means for turning off a developing bias used in the developing step in the state where the developing position enters the area having the potential distribution.

The above objects of the present invention are also achieved by an image forming apparatus in which an electrophotographic process including a uniform charging step, an exposure step, a developing step and a transfer step is performed on a photosensitive body which is driven so that an image is formed on a recording medium, the image forming apparatus comprising: discharging means for discharging the photosensitive body which has been uniformly charged; discharging control means for controlling the discharging means so that a second potential is obtained, from a start of driving the photosensitive body, as a potential at which the photosensitive body is discharged and so that a potential distribution is obtained in an area having a predetermined width at an end of discharging the photosensitive body, the potential distribution being between a first potential obtained by charging the photosensitive body and the second potential; and bias control means for turning on a developing bias used in the developing step in a state where a developing position enters the area having the potential distribution after the photosensitive body starts to be driven, the developing position being a position at which the developing step is performed on the photosensitive body.

Further, the above objects of the present invention are achieved by an image forming apparatus in which an electrophotographic process including a uniform charging step, an exposure step, a developing step and a transfer step is performed on a photosensitive body which is driven so that an image is formed on a recording medium, the image forming apparatus comprising: discharging means for discharging the photosensitive body which has been uniformly charged; discharging control means for activating the discharging means so that the photosensitive body is discharged at a predetermined potential before the photosensitive body is stopped; stop control means for performing an operation for stopping driving the photosensitive body in a state where a developing position at which the developing step is performed enters an area including a boundary between a leading edge of a portion discharged by the discharging means and a portion uniformly charged in the uniformly charging step; and bias control means for controlling a developing bias used in the developing step so that the developing bias is varied from a predetermined potential to an off potential in the state where the developing position enters the area including the boundary between the leading edge of the discharged portion and the uniformly charged portion, the off potential being a potential which is obtained when the developing bias is turned off.

The above objects of the present invention are also achieved by an image forming apparatus in which an electrophotographic process including a uniform charging step, an exposure step, a developing step and a transfer step is performed on a photosensitive body which is driven so that an image is formed on a recording medium, the image forming apparatus comprising: discharging means for discharging the photosensitive body which has been uniformly charged; discharging control means for controlling the discharging means so that a predetermined potential is obtained, from a start of driving the photosensitive body, as a potential at which the photosensitive body is discharged and so that the discharging means is brought into an inactive state at predetermined time; and bias control means for controlling a developing bias used in the developing step so that the developing bias is increased from an off potential to a predetermined potential, after the photosensitive body starts to be driven, in a state where a developing position at which the developing step is performed enters an area including a boundary between a trailing edge of a portion discharged by the discharging means and a portion uniformly charged in the uniform charging step.

According to the present invention, in a state where the developing position enters a boundary portion between the discharged area and the charged area on the photosensitive body, the difference between the developing bias and the surface potential on the photosensitive body is not suddenly changed. Thus, the amount of developer adhering to the boundary portion due to the difference between the developing bias and the surface potential on the photosensitive body can be decreased. As a result, an image having a high quality can be formed on the recording medium.

BRIEF DESCRIPTION OF THE DRAWINGS

Other objects, features and advantages of the present invention will become apparent from the following detailed description when read in conjunction with the accompanying drawings, in which:

FIG. 11 is a table indicating, in comparison with a conventional apparatus, an experimental result of an image forming process in the image forming apparatus according to the first embodiment of the present invention;

FIG. 18 is a diagram illustrating relationships between operation modes and dot matrix patterns;

FIG. 19 is a table indicating, in comparison with the conventional apparatus, experimental results of image forming processes in the image forming apparatuses according to the second embodiment;

FIGS. 20A, 20B and 20C are diagrams illustrating other examples of the dot matrix pattern;

DESCRIPTION OF THE PREFERRED EMBODIMENTS

Figure 5:
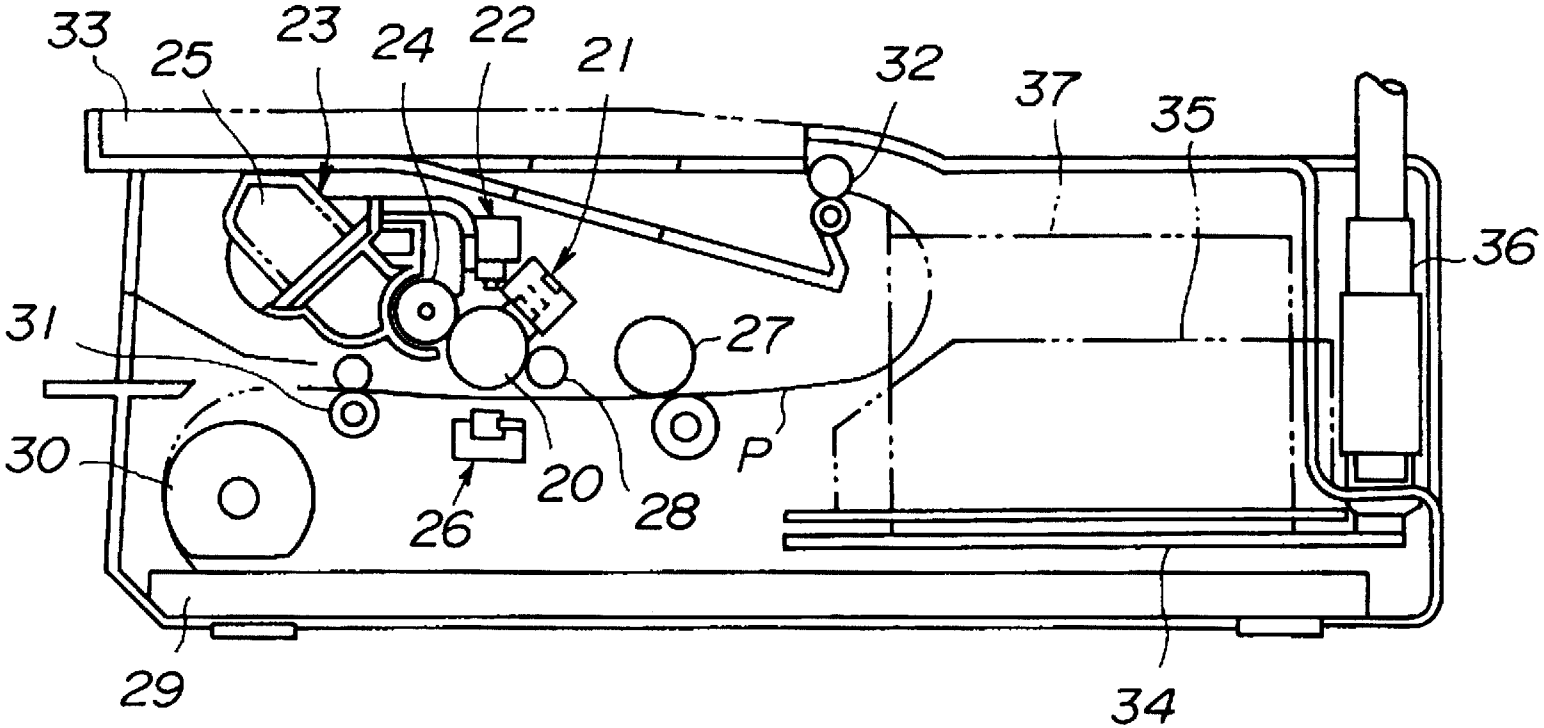
FIG. 5 is a diagram illustrating a structure of an image forming apparatus according to embodiments of the present invention.

A description will now be given, with reference to FIG. 5, of a structure of an image forming apparatus according to an embodiment of the present invention. The image forming apparatus shown in FIG. 5 is a cleanerless type electrophotographic printer (an electrophotographic apparatus). This printer exclusively uses recording sheets each having a size of A4. The width of a recording sheet having the maximum size capable of being used in this printer is 216 millimeters (a letter size).

Referring to FIG. 5, a photosensitive drum 20 has a structure in which organic photosensitive material having a thickness of 20 μm is applied to a drum made of aluminum. The outer diameter of the photosensitive drum 20 is 24 millimeters. The photosensitive drum 20 is rotated at a tip speed of 25 mm/sec. A pre-charger unit 21 uniformly charges the surface of the photosensitive drum 20. The pre-charger unit 21 is a non-contact type charger to charge the surface of the photosensitive drum to about −600 volts.

An optical unit 22 exposes, in accordance with image data, the photosensitive drum 20 which has been uniformly charged so that an electrostatic latent image is formed on the photosensitive drum 20. In this embodiment, for the sake of miniaturization, an LED optical system in which an LED array and a SELFOC lens are arranged is used as the optical unit 22. The width of an area onto which light beams from the LED array project is set at 216 millimeters which is the width of the maximum size (the letter size) recording sheet capable of being used in this printer. Due to the exposure process of the optical unit 22, the electrostatic latent image has a potential distributed in a range between −50 volts and −100 volts.

A developing unit 23 makes charged toner adhere to the electrostatic latent image formed on the photosensitive drum 20 so that a visible image is formed. The developing unit 23 has a developing roller 24 feeding developer to the photosensitive drum 20. The developing roller 24 is formed of a magnet roller having a plurality of magnetic poles and a sleeve which rotatably covers the magnet roller. In the developing unit 23, the sleeve of the developing roller 24 is rotated so that the developer is fed to the photosensitive drum 20. Two-component system developer is used. For the sake of ease of collecting residual developer on the photosensitive drum 20, carrier formed of small particles each having a size in a range between 30 μm and 50 μm is used. Magnetic polymerized toner which can be collected by use of magnetic force is used. The toner is agitated with the carrier in the developing unit 23 so as to be charged at a minus potential. The developing unit 23 has a toner cartridge 25 detachably set therein. The toner cartridge 25 is filled with the magnetic polymerized toner. When the toner in the toner cartridge 25 is used up, the toner cartridge 25 is replaced with a new one so that the toner is resupplied to the developing unit 23.

A transfer unit 26 includes a corona discharger device. The transfer unit 26 is used to electrostatically transfer a toner image on the photosensitive drum 20 to a recording sheet P. A high voltage in a range between 3 kilovolts and 10 kilovolts is applied to a corona wire of the corona discharger device. Due to the corona discharge generated from the corona wire to which the high voltage is applied, the back of the recording sheet P is charged. As a result, the toner image on the photosensitive drum 20 is transferred to the recording sheet P. A constant current power supply is used as the power supply for the transfer unit 26 in a desirable manner.

A scattering roller 28 is formed of a conductive foam rubber roller. An alternating current (AC) voltage is applied to the scattering roller 28. The scattering roller 28 scatters the toner (residual toner) which remains on the photosensitive drum 20 after the transfer process so that the residual toner can be easily collected by the developing unit 23. In addition, since the AC voltage is applied to the scattering roller 28, the photosensitive drum 20 is discharged so that the electrostatic latent image is completely removed and the photosensitive drum 20 is initialized.

A fixer unit 27 is formed of a heat roller having a halogen lamp used as a heat source and a pressure roller (a back-up roller). The fixer unit 27 heats the recording sheet P with pressure so that the toner image is fixed on the recording sheet P.

A sheet cassette 29 in which recording sheets P are housed is set in the printer. The sheet cassette 29 can be detached from a front surface (the left side in FIG. 5) of the printer. Recording sheets having the letter size can be housed in the sheet cassette 29. A pick-up roller 30 picks up and feeds a recording sheet located on a top of the stacked recording sheets P in the sheet cassette 29. A resist roller 31 temporarily resists the recording sheet P picked up and fed by the pick-up roller 30. After this, the recording sheet P is fed toward the transfer unit 26 by the resist roller 32. After the recording sheet P passes through the fixer unit 27, the recording sheet is ejected to a stacker 33 by an ejecting roller 32. The stacker 33 is formed on a top of the printer. Recording sheets ejected by the ejecting roller 32 are successively stacked on the stacker 33.

The printer is further provided with a printed-circuit board 34 on which a control circuit is formed, a power supply 35 and an optional board 37. An I/F connector 36 is connected to an external cable and to a connector of the printed-circuit board 34. The optional board 37 is provided with an emulation circuit, a font memory and other circuits.

The printer having the above structure operates as follows.

The surface of the photosensitive drum 20 is uniformly charged at −600 volts by the pre-charger unit 21. The LED optical system 22 exposes the photosensitive drum 20 which has been charged. As a result, an electrostatic latent image in which a background portion has a potential of −600 volts and printed portions have potentials in a range between −50 volts and −100 volts is formed on the photosensitive drum 20.

A developing bias voltage (−450 volts) is applied to the sleeve of the developing roller 24 of the developing unit 23. In the developing unit 23, the carrier and the magnetic polymerized toner are agitated so that the magnetic polymerized toner is charted at a minus potential. The electrostatic latent image is developed using the magnetic polymerized toner charged at the minus potential, so that a toner image is formed on the photosensitive drum 20.

A recording sheet P picked up from the sheet cassette 29 by the pick-up roller 30 is fed toward the transfer unit 26 via the resist roller 31. The toner image on the photosensitive drum 20 is transferred to the recording sheet P due to an electrostatic field generated between the recording sheet charged by the transfer unit 26 and the toner image. The toner image is fixed on the recording .sheet P by the fixer unit 27. The recording sheet P on which the toner image is fixed passes through a U-shaped path and is ejected to the stacker 33 by the ejecting roller 32.

After the toner image is transferred to the recording sheet P, the residual toner on the photosensitive drum 20 is scattered by the scattering roller 28. The scattered residual toner passes through a pre-charging position (corresponding to the pre-charger unit 21) and an exposure position (corresponding to the LED optical system 22) and reaches a developing position (corresponding to the developing unit 23). While the next developing process is being performed, the residual toner is collected by the developing roller 24. The toner collected by the developing roller 24 is reused in the developing unit 23.

A description will now be given of a control system of the printer and an operation sequence in the electrophotographic process performed on the photosensitive drum 20.

Figure 6:
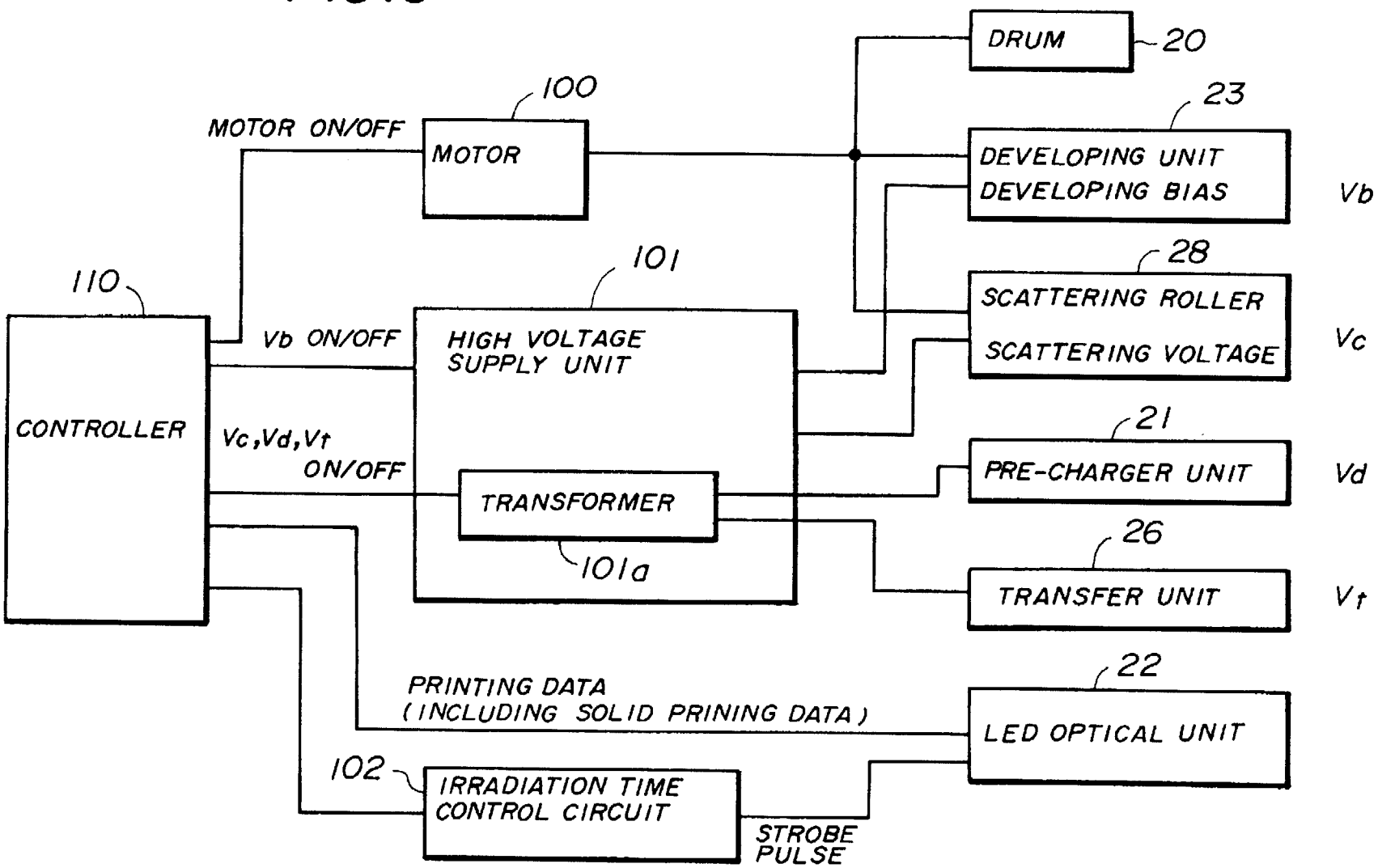
FIG. 6 is a block diagram illustrating a control system of the image forming apparatus according to a first embodiment of the present invention.

In a first embodiment, the control system is formed as shown in FIG. 6. Referring to FIG. 6, for the sake of miniaturization of the printer, the photosensitive drum 20, the developing unit 23 and the scattering roller 28 are driven by a single motor 100. A high voltage Vd for the pre-charger unit 21, a high voltage Vt for the transfer unit 26, the developing bias Vb for the developing unit 23 and a scattering voltage Vc for the scattering roller 28 are generated by a high-voltage supply unit 101. In this embodiment, the developing bias Vb can be independently turned on and off. The pre-charger unit 21 and the transfer unit 26 are connected to secondary coils of a high-voltage transformer having a single primary coil so that the high voltage Vd of the pre-charger unit 21 and the high voltage Vt of the transfer unit 26 are turned on and off using a single control signal. As a result, the high-voltage power unit 101 is miniaturized. The scattering roller 28 is provided with the scattering voltage Vc which is an AC voltage having a peak-to-peak voltage difference of 1300 volts. As a result, the scattering roller 28 has not only a function for scattering the residual toner on the photosensitive drum 20 but also a function for discharging the photosensitive drum 20. To control the LED optical system, printing data and strobe pulses each of which corresponds to a time for which the LED is irradiating are used. In this control system, for an entire exposure to be described later, solid printing data corresponding to a black solid image is stored. The solid printing data is supplied to the LED at a predetermined timing. The width of each of the strobe pulses is controlled, based on an instruction from a controller 110, by an irradiation time control circuit 102.

A description will now be given of an operation sequence of the printer unit.

Figure 7:
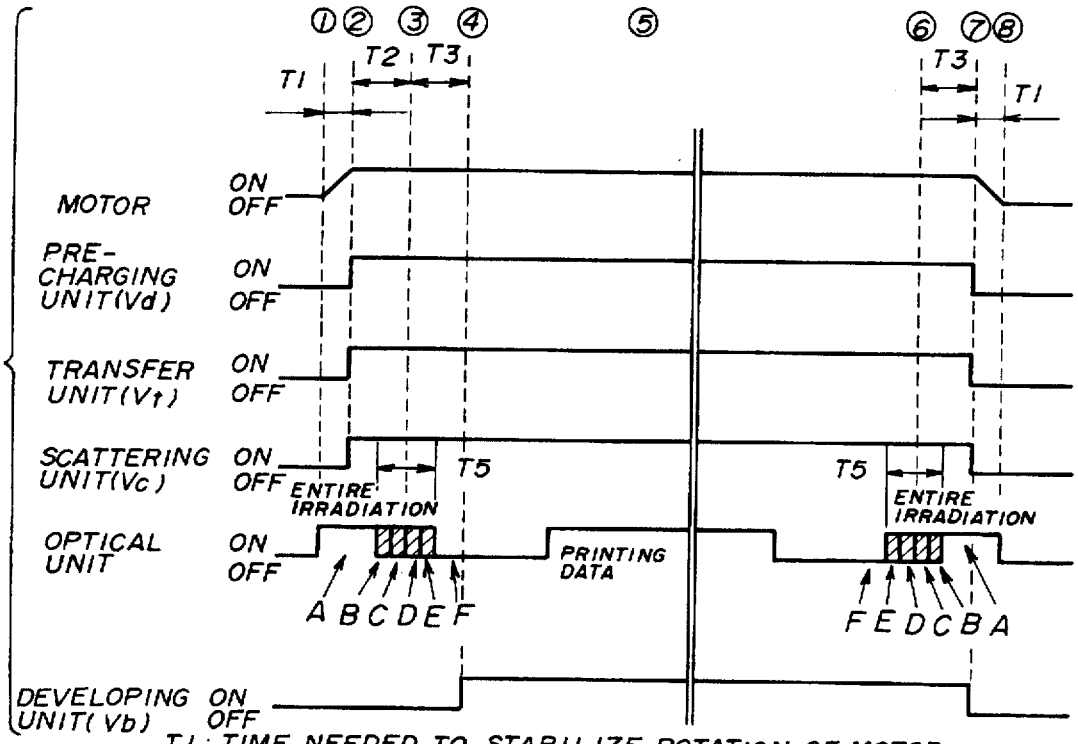
FIG. 7 is a timing chart illustrating a operation sequence of the image forming apparatus according to the first embodiment of the present invention.
Figure 8:
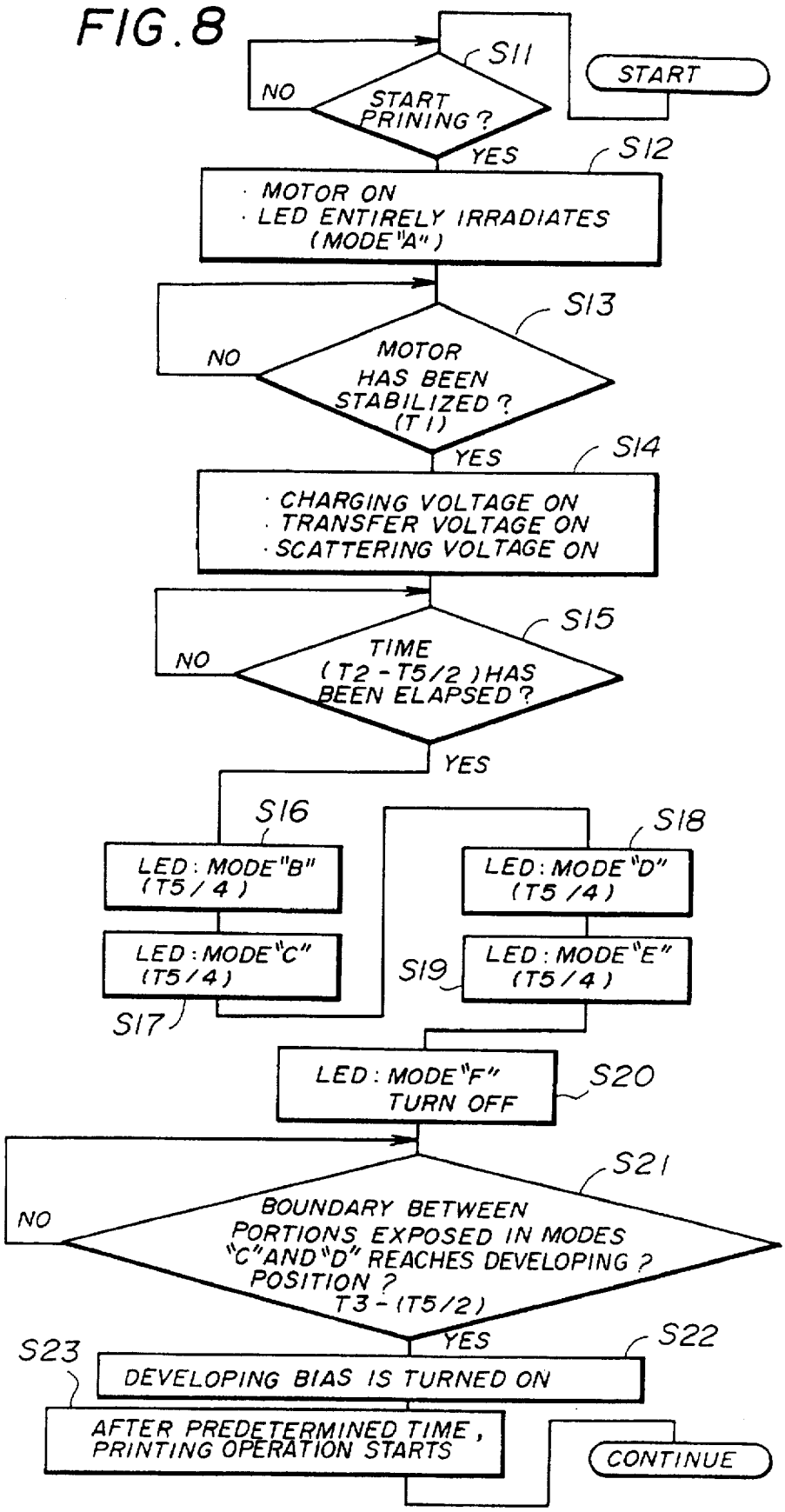
FIG. 8 is a flowchart illustrating a first part of a process corresponding to the operation sequence shown in FIG. 7.
Figure 9:
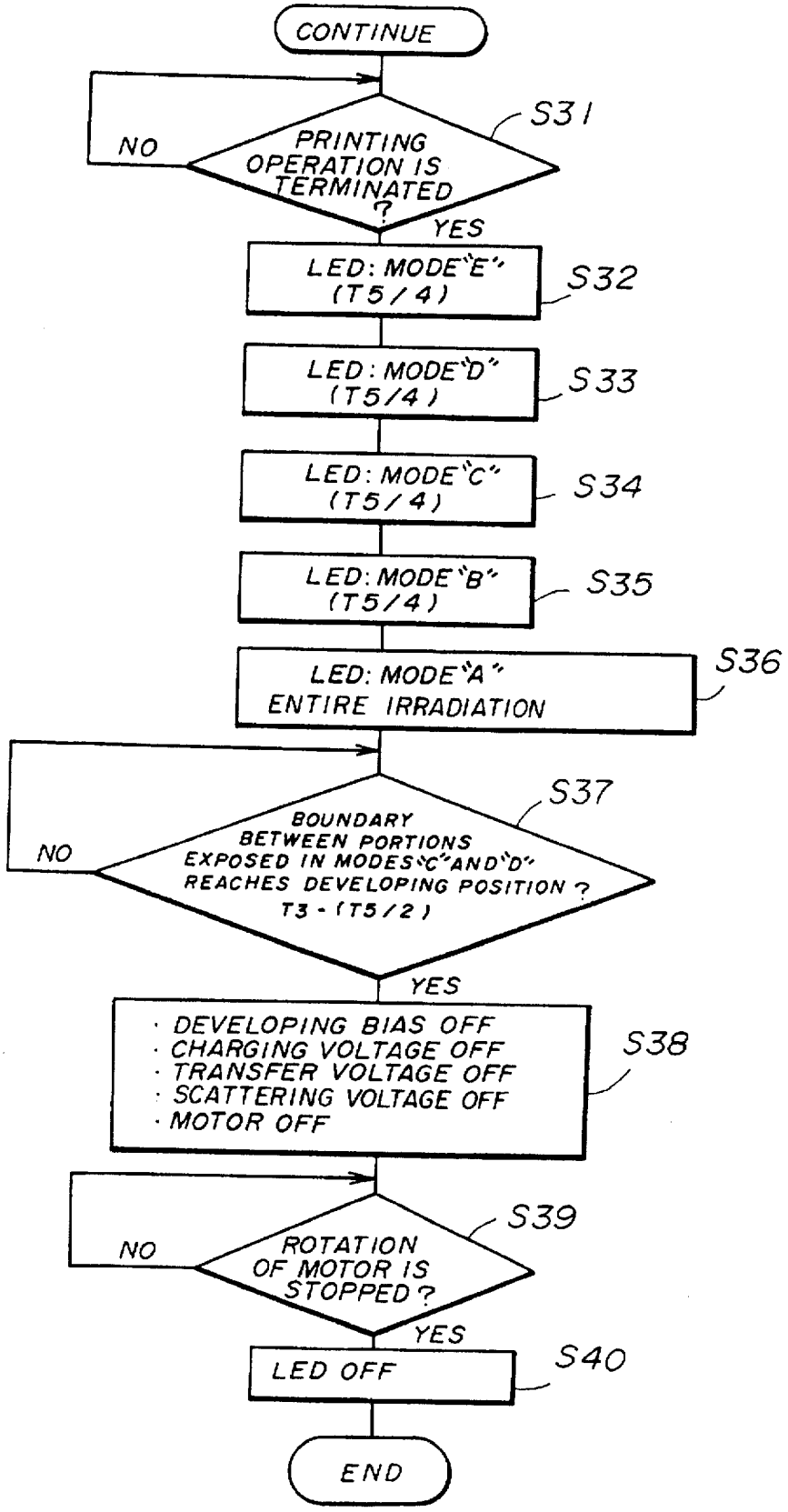
FIG. 9 is a flowchart illustrating a second part of the process corresponding to the operation sequence shown in FIG. 7.

FIG. 7 shows the operation sequence and FIG. 8 and FIG. 9 show a process corresponding to the operation sequence. In this embodiment, when the entire exposure (the photosensitive drum 20 is entirely exposed) performed by the LED optical system 22 starts and is terminated, a time for which each LED corresponding to a dot irradiates is controlled so that the surface potential of the photosensitive drum 20 is gradually varied.

Referring to FIG. 7 and FIG. 8, when a start instruction for a printing operation occurs at a time ① (S11), the motor 100 is activated to drive the photosensitive drum 20 and the developing unit 23 (S12). The motor 100 is controlled so that a revolving speed is gradually increased. At this time, the controller 110 supplies the solid printing data to the LED optical unit 22, so that the photosensitive drum 20 is entirely exposed (the entire exposure) and the surface potential of the photosensitive drum 20 is decreased (S12). In this step S12, the width of the strobe pulse is set at 90 μsec which corresponds to an irradiation time of a LED for one dot (a mode "A").

When it is determined, at a time ②, that the revolving speed of the motor 100 has reached a predetermined speed (S13), the high voltages: the charging voltage Vd, the transfer voltage Vt and the scattering voltage Vc are simultaneously turned on (S14).

Immediately before and after a time ③, a modulation control of the LED optical unit 22 is performed. When it is determined that a predetermined time (T2–T5/2) has elapsed since turning on the high voltages (S15), the irradiation time of the LED in a period T5/4 (corresponding to one dot) is decreased by stages from a mode "B" to a mode "F" (S16, S17, S18 and S19). T5 is a time which is needed to move the surface of the photosensitive drum 20 by a distance corresponding to the developing-nip area. In the printer according to this embodiment, for example, the width of the developing-nip area (in which the developer of the developing unit 23 is in contact with the photosensitive drum 20) is 3 millimeters and the tip speed of the photosensitive drum 20 is 25 mm/sec. In this case, the T5 is set at 120 milliseconds. During this time T5, the irradiation time for each dot is decreased by stages from the maximum value (mode "A": 90 μsec) to the minimum value (mode "E": 3 μsec). Finally, the LED optical unit 22 is turned off (mode "F"). In the respective modes, the irradiation time of an LED for each dot has been decided as indicated in Table-1.

TABLE 1

| MODE | IRRADIATION TIME | NOTE |
|---|---|---|
| A | 90 μsec | in printing & entire exposure |
| B | 30 μsec | |
| C | 20 μsec | |
| D | 5 μsec | |
| E | 3 μsec | |
| F | 0 μsec | not exposed |

If it is determined, at a time ④, that a boundary between a portion exposed in the mode "C" and a portion exposed in the mode "D" reaches the developing position facing the developing unit 23 S21), the developing bias Vb is turned on (S22). The determination in step S21 is performed based on whether a predetermined time (T3–T5/2) has elapsed since the time ③ corresponding to the boundary between the portions exposed in the modes "C" and "D". The time T3 is a time which is needed to move the surface of the photosensitive drum 20 from an exposure position at which light from the LED optical unit 22 is projected to the developing position.

Figure 3:
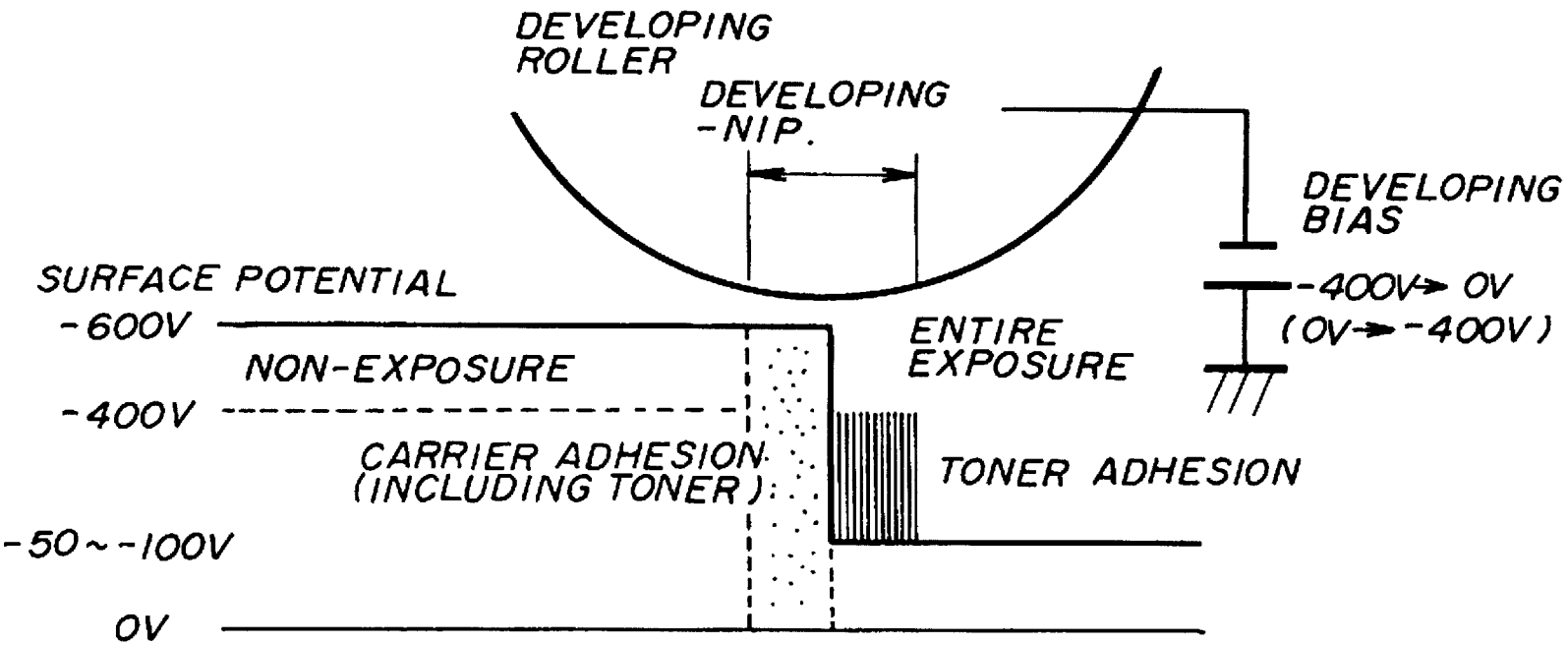
FIG. 3 (PRIOR ART)
FIG. 3 is a diagram illustrating a state of potential in a potential boundary portion formed on a photosensitive drum of the conventional electrophotographic apparatus.
Figure 10:
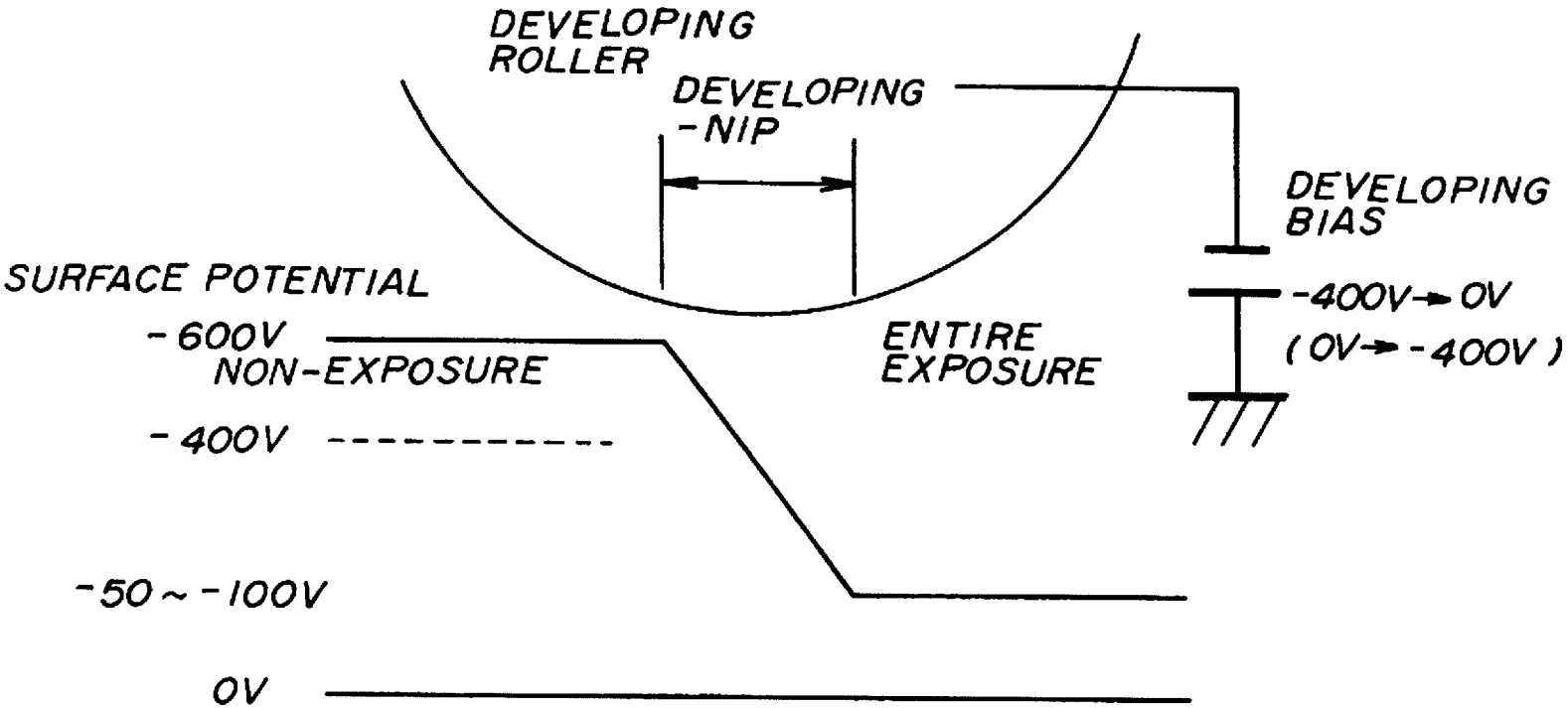
FIG. 10 is a diagram illustrating a state of potential in a potential boundary portion formed on a photosensitive drum.

According to the above control of the LED optical unit 22, .immediately before and after the developing bias Vb is turned on, the surface potential distribution in the developing-nip area on the photosensitive drum 20 is sloped as shown in FIG. 10 (sloping potential). That is, immediately before the developing bias Vb is turned on, a portion in which the difference between the developing bias Vb (=0 volts) and the surface potential is large is less than a corresponding portion in the conventional case shown in FIG. 3. In addition, immediately after the developing bias Vb is turned on, a portion in which the difference between the developing bias Vb (=–400 volts) and the surface potential is large is less than a corresponding portion in the conventional case shown in FIG. 3. Thus, the electrostatic force generated between the developing roller 24 and the photosensitive drum 20 in the developing-nip area is small. As a result, the amount of toner and carrier which adheres to the photosensitive drum 20 when the developing bias is turned on is reduced.

In a period ⑤ shown in FIG. 7, when a predetermined time has elapsed since turning on the developing bias Vb, printing data is supplied to the LED optical unit 22. The LED optical unit 22 exposes the photosensitive drum 20 in accordance with the printing data (S23). That is, a printing operation starts.

In this case, each point on the surface of the photosensitive drum 20 passes through the developing position at least once before the printing operation starts so that residual toner and carrier on the surface of the photosensitive drum 20 are collected by the developing unit 23. In addition, after the printing operation is terminated, each point on the surface of the photosensitive drum 20 passes through the developing position at least once so that the residual toner and carrier are collected by the developing unit 23.

Further description will now be given, with reference to FIG. 7 and FIG. 9, of the operation sequence of the printer unit.

Referring to FIGS. 7 and 9, when it is determined that the printing operation is terminated (S31), the LED optical unit 22 is activated so as to entirely expose the surface of the photosensitive drum 20 before the photosensitive drum 20 is stopped. In an initial period including a time ⑥ shown in FIG. 7, the strobe pulse supplied to the LED optical unit 22 is controlled so that the width is increased by stages to increase the surface potential of the photosensitive drum 20 by stages. Under this control, the operation mode of the LED optical unit 22 is changed from the mode "F" through the modes "E", "D", "C" and "B" to the mode "A" in this order opposite to the order in the case before the printing operation starts (S32, S33, S34, S35 and S36).

It is determined, at a time ⑦, that a boundary between a portion exposed in the mode "C" and a portion exposed in the mode "D" reaches the developing position (S37). Then, the developing bias Vb is turned off (S38). This determination in step S37 is performed based on whether a predetermined time (T3–T5/2) has elapsed from the time ⑥ corresponding to the boundary between the operations in the modes "C" and "D". When the developing bias Vb is turned off, the charging voltage Vd, the transfer voltage Vt and the scattering voltage Vc are simultaneously turned off (S38).

In this case, the developing bias Vb is turned off in a state where the surface potential distribution is sloped in the developing-nip area on the photosensitive drum 20 in the same manner as in the above case (in the period including the time ③) before the printing operation starts. Thus, the amounts of toner and carrier adhering to the photosensitive drum 20 immediately before and after the developing bias Vb is turned off are reduced, as has been described above.

After this, the revolution speed of the motor 100 is gradually decreased. Then, when it is determined that the motor 100 has stopped (S39), the LED optical unit 22 is brought into an inactive state so that the entire exposure process for the photosensitive drum 20 is terminated (S40).

According to the printer (the image forming apparatus) according to the first embodiment of the present invention, the surface potential distribution on a trailing edge portion of an area which is entirely exposed immediately after the photosensitive drum 20 starts to rotate and the surface potential distribution on a leading edge portion of an area which is entirely exposed immediately before the photosensitive drum 20 is stopped are respectively sloped. When the above areas and the developing-nip area are overlapped, the developing bias Vb is turned on and off. Thus, the amounts of residual toner and carrier can be reduced.

Figure 1:
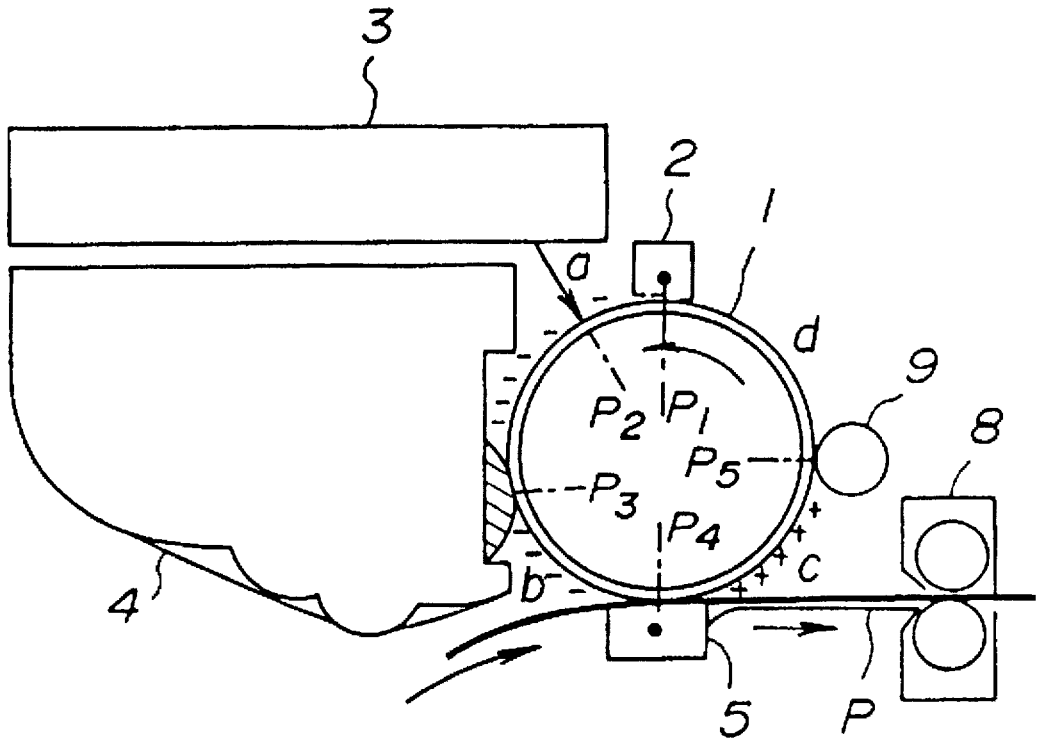
FIG. 1 (PRIOR ART)
FIG. 1 is a diagram illustrating a structure of an electrophotographic apparatus having no cleaner.
Figure 2:
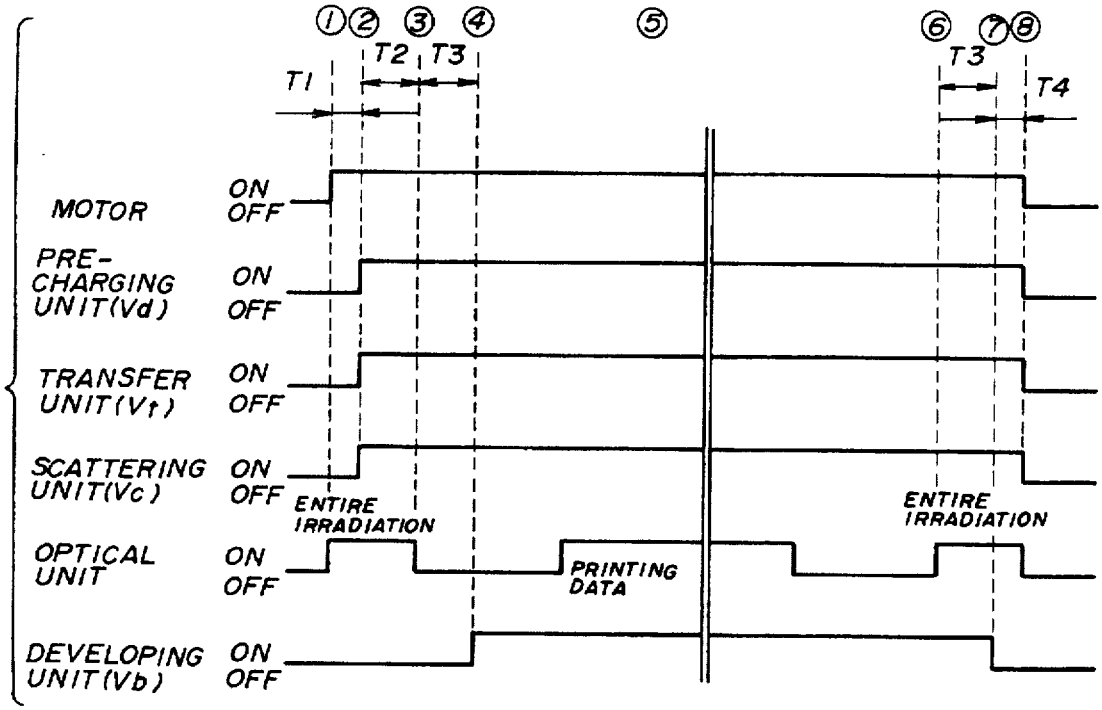
FIG. 2 (PRIOR ART)
FIG. 2 is a timing chart illustrating an operation sequence in a conventional electrophotographic apparatus.
Figure 4:
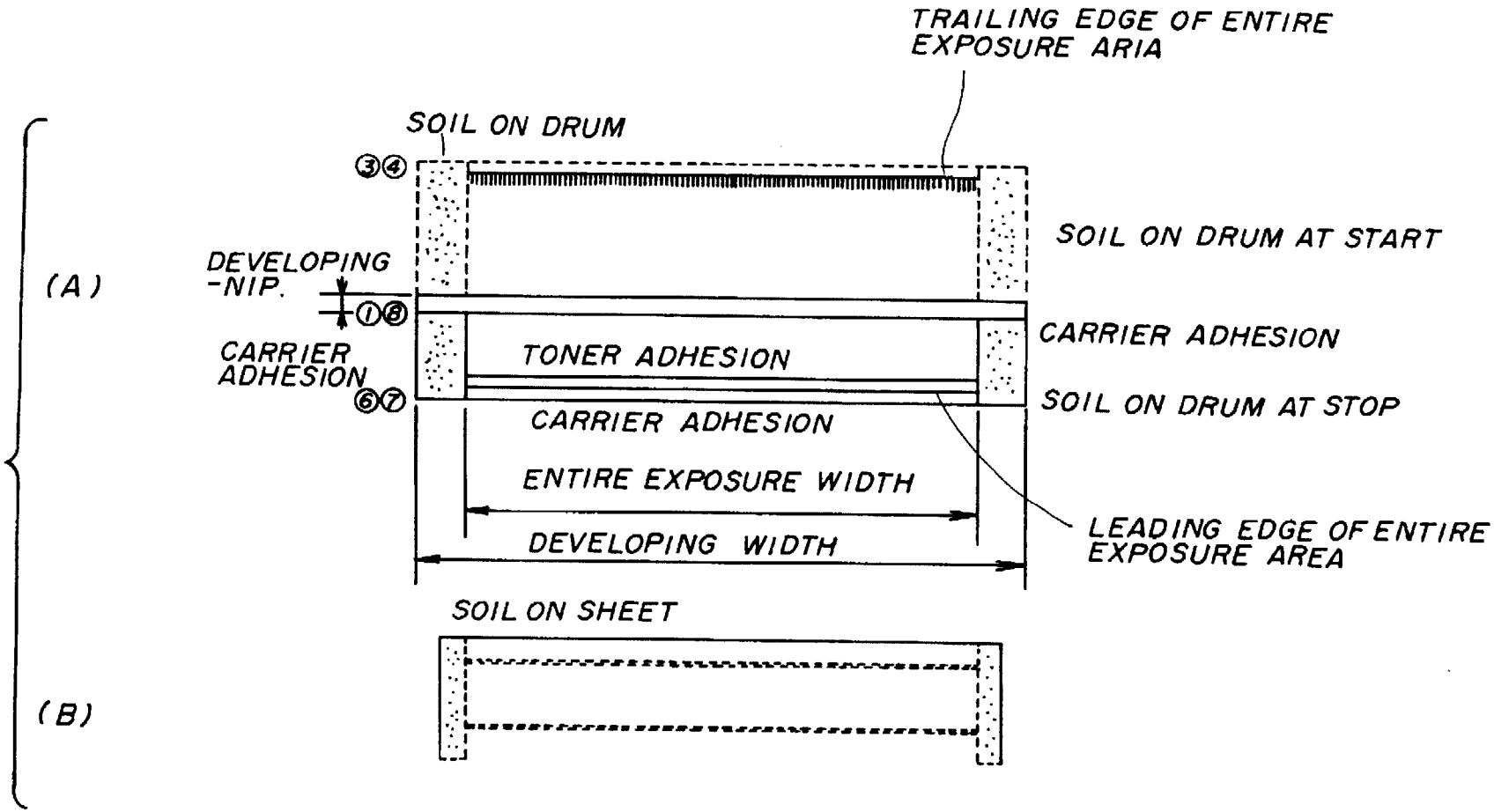
FIG. 4 (PRIOR ART)
FIG. 4 is a diagram illustrating states of toner and carrier which adhere to the photosensitive drum and a sheet.

FIG. 11 shows results of an experiment. Referring to FIG. 11, a recording sheet on which an image was formed by the conventional image forming apparatus controlled in accordance with the operation sequence as shown in FIG. 2 was soiled by toner as shown in FIG. 4(B) (the conventional case). However, a recording sheet on which an image was formed by the printer controlled in accordance with the operation sequence described above was not soiled by toner (the first embodiment).

In addition, the LED array of the LED optical unit 22 has the same width (e.g., 216 millimeters) as a recording sheet (e.g., a letter-sized recording sheet) which has the maximum width capable of being used in the printer. In the entire exposure operation of the LED optical unit 22 (in the mode "A"), an area having the same width as the recording sheet having the maximum width is discharged on the photosensitive drum 20. Thus, even if the recording sheet having the maximum width is used in the printer, both side edge portions of the recording sheet are not soiled by toner and carrier in the printing operation.

In the first embodiment, the area in which the surface potential distribution is sloped on the photosensitive drum 20 has the same width as the developing-nip area. The width of the area in which the surface potential distribution is to be sloped depends on electrostatic and magnetic properties of the developer, variation of the arrangement of magnetic poles in the two-component system developing unit, and an electrical property of the power supply for the developing bias. Thus, the width of area in which the surface potential distribution is to be sloped is decided based on the above various properties in the image forming apparatus. It is desirable that the width of the area in which the surface potential distribution is to be sloped falls within a range between half of the width of the developing-nip area and twice as large as the width of the developing-nip area.

Figure 12:
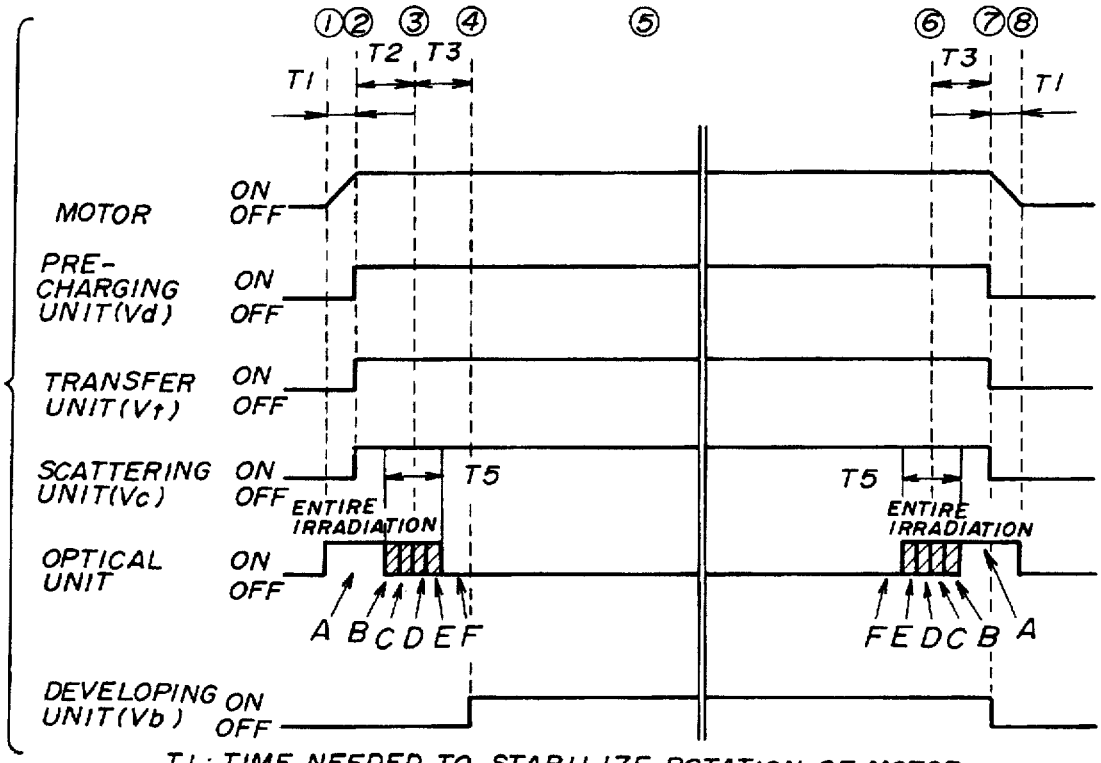
FIG. 12 is a timing chart illustrating an operation sequence immediately before and after an initial operation of the image forming apparatus according to the first embodiment.

Further, in the first embodiment, the entire exposure operation is performed when the printing operation starts and when the printing operation is terminated. However, the entire exposure operation may be a part of an initial operation which should be performed immediately after the system power is turned on and immediately after the apparatus restarts after, for example, recovery of paper jam. In this case, the entire exposure operation is performed in accordance with an operation sequence shown in FIG. 12. In the operation sequence shown in FIG. 12, there is no printing operation as included in the operation sequence shown in FIG. 7.

Different tables (see Table-1) in which irradiation times for each dot (each LED) in the previous modes are indicated may be used in the entire exposure operation immediately after the photosensitive drum 20 starts and immediately before the photosensitive drum 20 is stopped.

A description will now be given of a modification of the first embodiment of the present invention.

Figure 13:
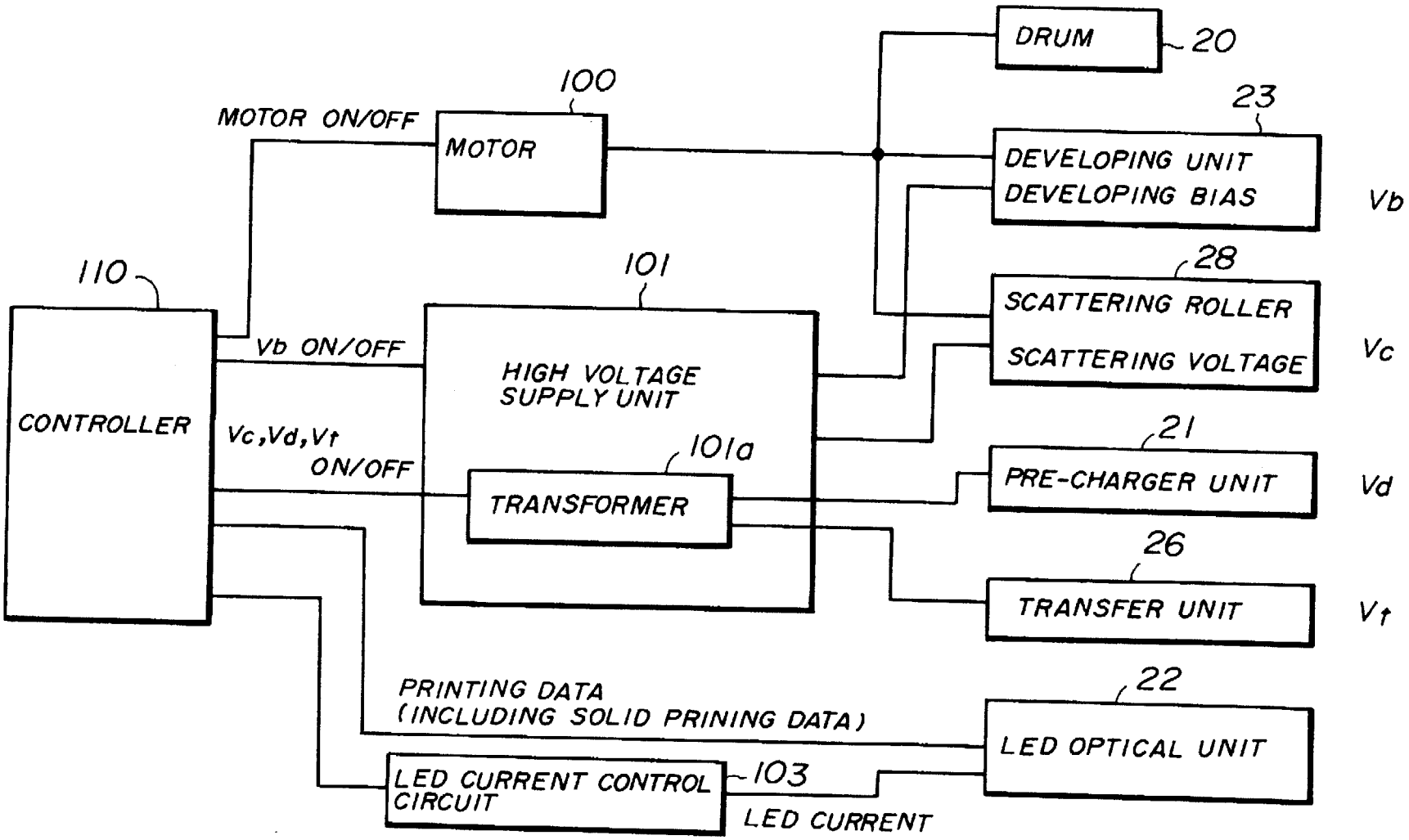
FIG. 13 is a block diagram illustrating a control system in a modification of the image forming apparatus according to the first embodiment.

In the first embodiment as has been described above, in order to obtained the sloped surface potential distribution, the width of the strobe pulse is controlled so that the irradiation time of each LED corresponding to a dot is controlled. In this modification, the amount of irradiation of each LED is controlled. In this case, the control system is provided with a LED current control circuit 103 as shown in FIG. 13, instead of the irradiation time control circuit 102 shown in FIG. 6. The LED current control circuit 103 controls the amount of current supplied to each LED in accordance with an instruction from the controller 110 so that the surface potential distribution in each of the trailing edge portion and the leading edge portion of the area which are entirely exposed by the LED optical unit 22 is sloped. As a result, in the same manner as in the first embodiment, the recording sheet on which an image is formed is not soiled by the toner and carrier.

A description will now be given of an electrophotographic apparatus according to a second embodiment of the present invention.

In the second embodiment, the trailing edge portion of the area which is to be entirely exposed immediately after the photosensitive drum 20 starts and the leading edge of the area which is to be entirely exposed immediately before the photosensitive drum 20 is stopped are exposed in accordance with predetermined dot area modulation patterns. As a result, the surface potential distribution in the trailing edge portion and the leading edge portion of the area which is entirely exposed can be virtually sloped.

Figure 14:
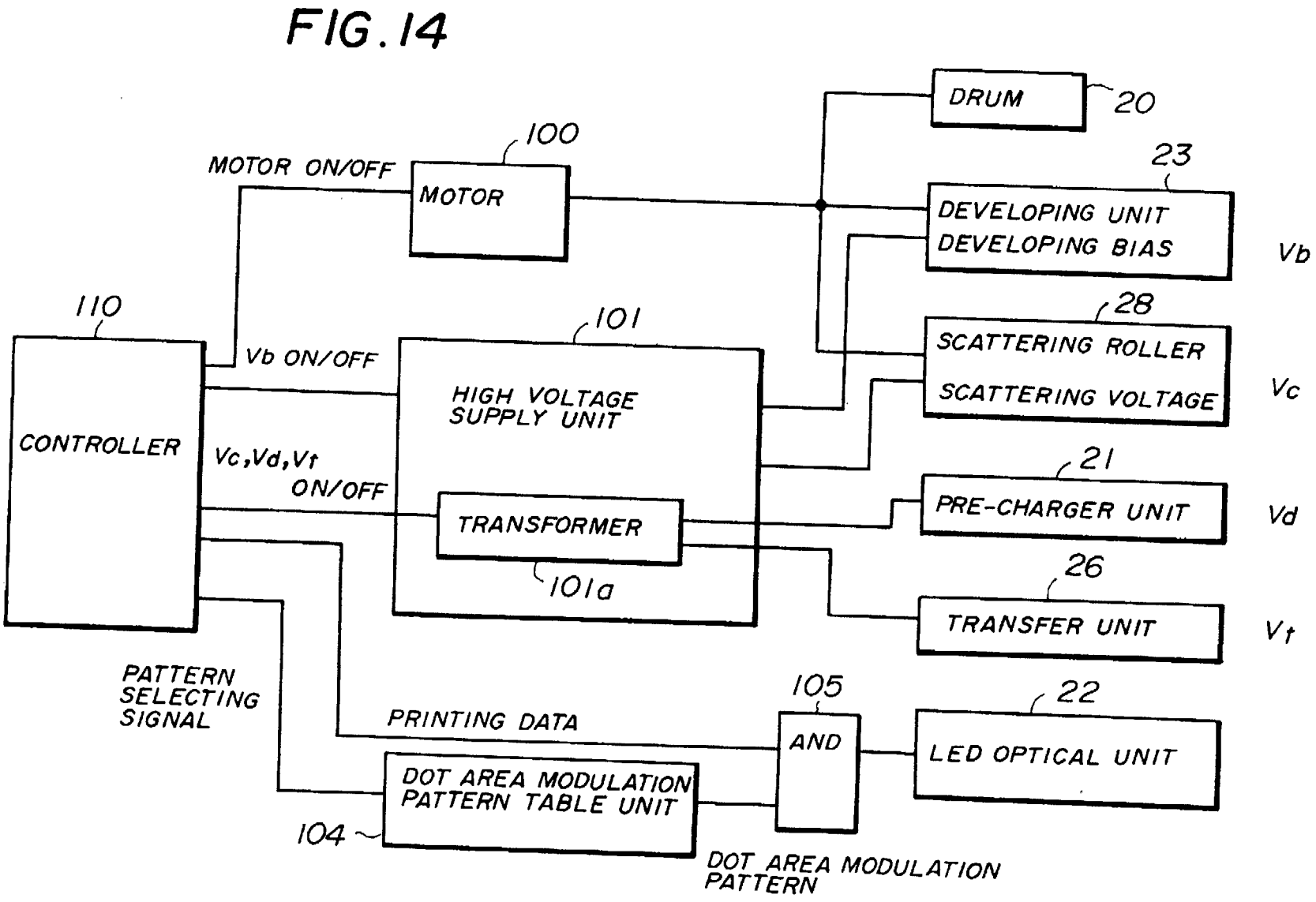
FIG. 14 is a block diagram illustrating a control system in the image forming apparatus according to a second embodiment of the present invention.

The electrophotographic apparatus according to the second embodiment has the structure shown in FIG. 5 in the same manner as in the first embodiment. The control system is formed as shown in FIG. 14. In FIG. 14, those parts which are the same as those shown in FIG. 6 are given the same reference numbers. The description of those parts will be omitted below.

Referring to FIG. 14, the control system is provided with a dot-area modulation-pattern table unit 104 and an AND circuit 105 instead of the irradiation time control circuit 102 shown in FIG. 6. The dot-area modulation-pattern table unit 104 outputs dot-area modulation-pattern data in accordance with instructions from the controller. The printing data corresponding to an image to be printed is output from the controller 110. The printing data and the dot-area modulation pattern data from the dot area modulation-pattern table unit 104 are supplied to the AND circuit 105. A logical AND signal of the printing data and the dot-area modulation-pattern data is supplied to the LED optical unit 22 as a driving signal.

Figure 15:
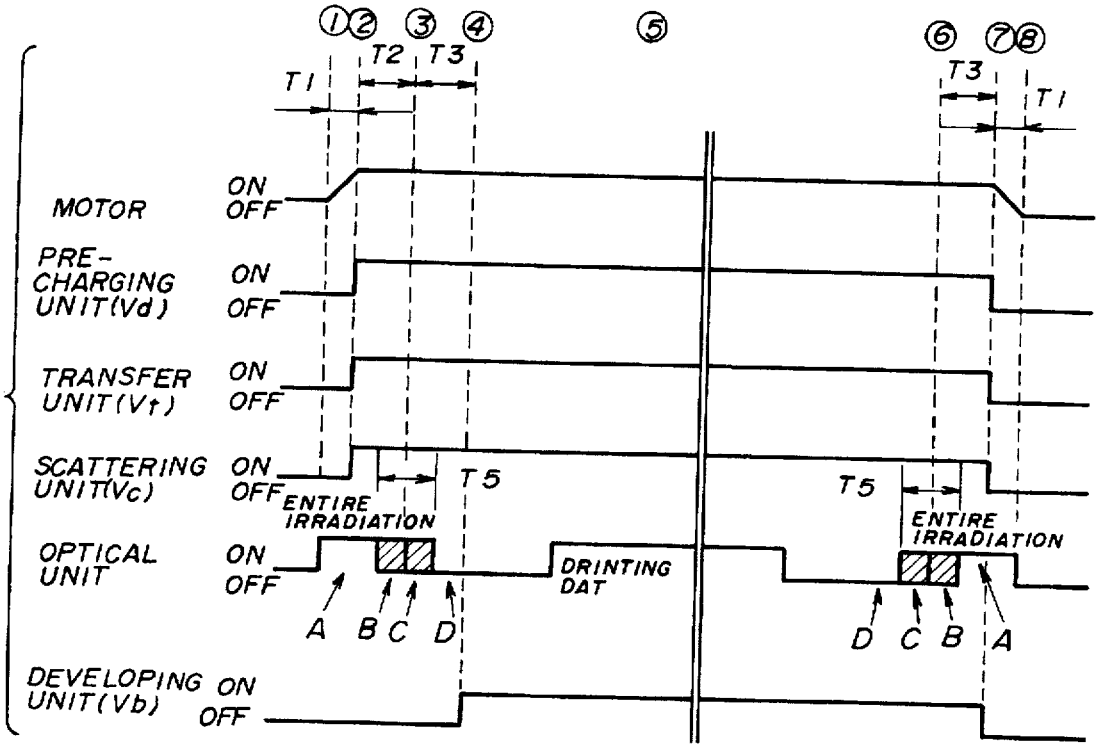
FIG. 15 is a timing chart illustrating an operation sequence of the control system shown in FIG. 14.
Figure 16:
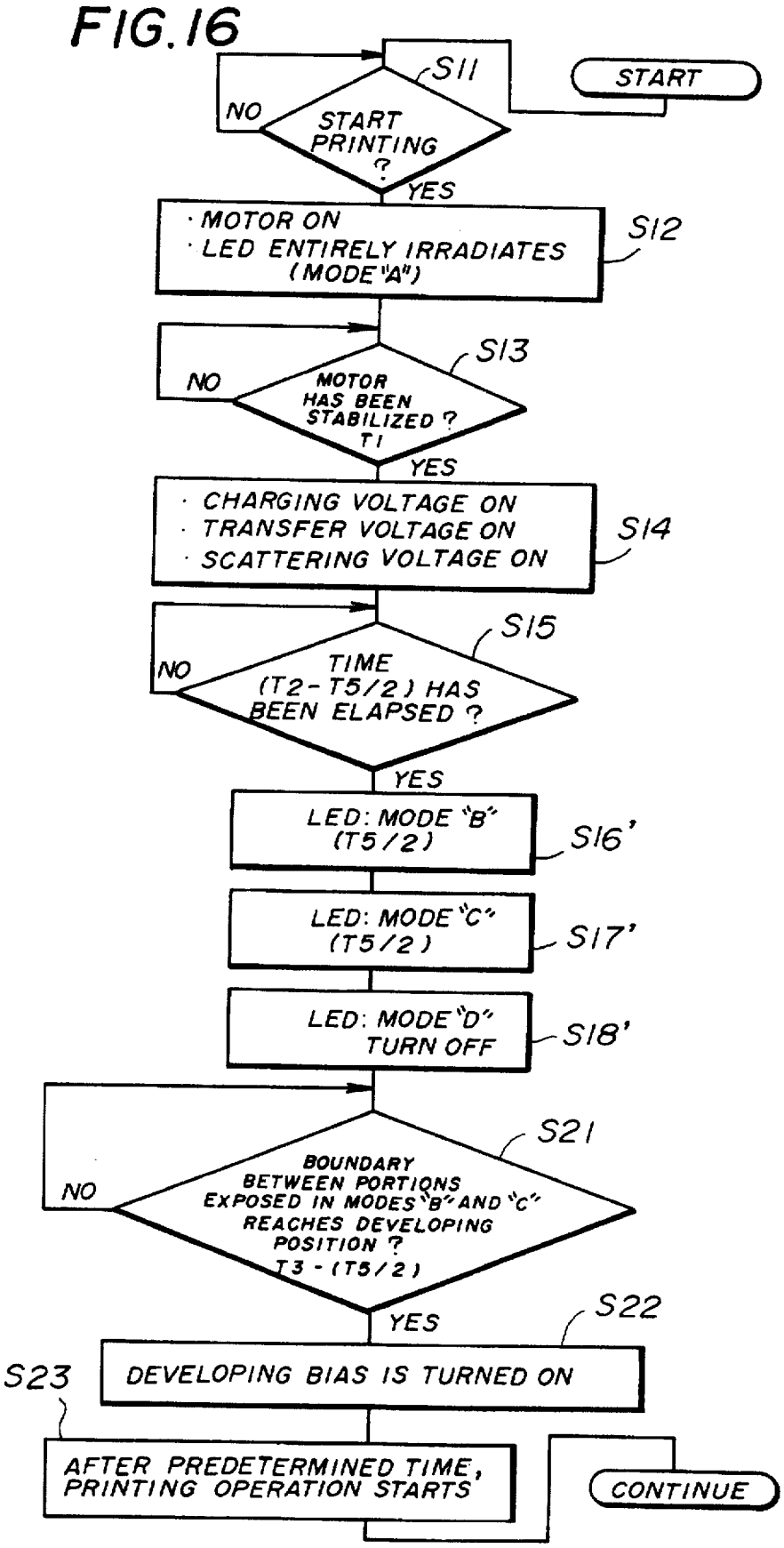
FIG. 16 is a flowchart illustrating a first part of a process corresponding to the operation sequence shown in FIG. 15.
Figure 17:
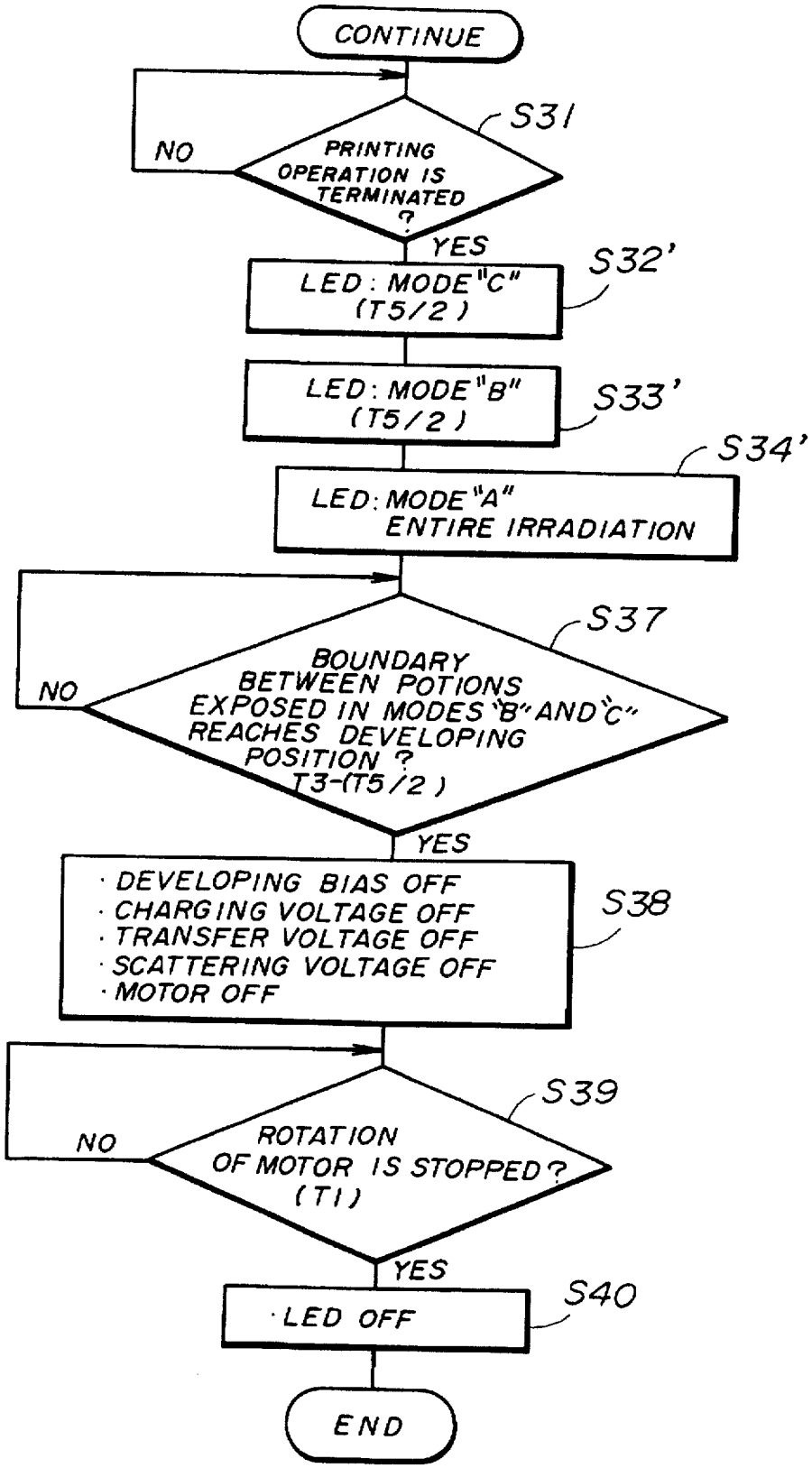
FIG. 17 is a flowchart illustrating a second part of the process corresponding to the operation sequence shown in FIG. 15.

FIG. 15 shows the operation sequence and FIG. 16 and FIG. 17 show a process corresponding to the operation sequence. A description will now be given of the process in accordance with the operation sequence.

In the operation sequence in the second embodiment, the operations immediately before and after a time ③ and immediately before and after a time ⑥ differ from corresponding operations shown in FIG. 7 in the first embodiment.

Referring to FIG. 15 and FIG. 16, the motor 100 starts and the entire exposure operation by the LED optical unit 22 (a mode "A") starts in the same manner as in the first embodiment (S11 and S12). In a state where the motor 100 is stably rotated, the charging voltage Vd, the transfer voltage Vt and the scattering voltage Vc are simultaneously turned on (S13 and S14).

A modulation control of the LED optical unit 22 is performed immediately before and after the time ③. When it is determined that a predetermined time (T2–T5/2) has been elapsed since the above voltages are turned on (S15), the operation mode of the LED optical unit 22 is changed from the mode "A" through modes "B" and "C" to a mode "D" by stages (S16', S17'and S18'). As a result, a pattern (the dot-area modulation pattern) in which the LEDs irradiate is changed at time intervals, each of which is T5/2, corresponding to half of the width of the developing-nip area. The area of the dot-area modulation pattern in which the photosensitive drum 20 is exposed is decreased in accordance with the order of the modes "A", "B", "C" and "D" so that the surface potential distribution is virtually sloped. The dot-area modulation patterns used in the respective modes "A", "B", "C" and "D" are shown in FIG. 18. Referring to FIG. 18, in the mode "A", the photosensitive drum 20 is entirely exposed. In the mode "D", the photosensitive drum 20 is not exposed (the area of the dot-area modulation pattern is zero). In the modes "B" and "C", the photosensitive drum 20 is exposed in predetermined dot-area modulation patterns. A time T5 for which the photosensitive drum 20 is being exposed in the modes "B" and "C" is set at 120 msec, which is a time needed to move the surface of the rotated photosensitive drum 20 by a length corresponding to the width of the developing-nip area, in the same manner as in the first embodiment.

When it is determined that the boundary between portions exposed in the modes "B" and "C" reaches the developing position (S21), the developing bias Vb is turned on (S22). That is, when the portion in which the surface potential distribution is virtually sloped on the photosensitive drum 20 overlaps with the developing-nip area, the developing bias Vb is tuned on. Thus, the difference between the developing bias Vb and the surface potential in the portion having the sloped surface potential distribution is substantially decreased as described in the first embodiment. As a result, toner and carrier is prevent from adhering to the trailing end portion of the area which is entirely exposed on the photosensitive drum 20.

Further, the process is performed in accordance with a procedure shown in FIG. 17. Referring to FIG. 15 and FIG. 17, after it is determined that the printing operation is terminated (S31), the LED optical unit 22 is controlled so that the entire exposure operation is performed immediately before the photosensitive drum 20 is stopped. In this entire exposure operation, immediately before and after a time ⑥ shown in FIG. 6, the operation mode of the LED optical unit 22 is changed from the mode "D" through the modes "C" and "B" to the mode "A", and the photosensitive drum 20 is exposed such that an exposed area is increased by stages (S32', S33' and S34').

When it is determined, at a time ⑦, that the boundary between portions exposed in the modes "C" and "B" reaches the developing position (S37), the developing bias Vb applied to the developing unit 23 is turned off (S38). At this time, the charging voltage Vd, the transfer voltage Vt, the scattering voltage Vc and a voltage applied to the motor 100 are simultaneously turned off. When T1 elapses from the time ⑦ at a time ⑧), the LED optical unit 22 is brought into an inactive state.

In the entire exposure operation performed immediately before the photosensitive drum 20 is stopped, when the area in which the surface potential distribution is virtually sloped on the photosensitive drum 20 overlaps with the developing-nip area, the developing bias Vd is turned off. Thus, in the same manner as in the case of the entire exposure operation performed immediately after the photosensitive drum starts, the toner and carrier is prevented from adhering to the photosensitive drum 20.

Results of an experiment is shown in FIG. 19. In the experiment, seven sample printers (#1 to #7) were controlled in accordance with the operation sequence described in the second embodiment and seven conventional printers (#1 to #7) were controlled in accordance with the operation sequence shown in FIG. 2. From the result of the experiment, it is known that in the sample printers according to the second embodiment, the amount of toner and carrier adhering to the trailing edge portion of an area entirely exposed immediately after the photosensitive drum 20 starts and the amount of toner and carrier adhering to the leading edge portion of an area entirely exposed immediately before the photosensitive drum 20 is stopped were decreased. As a result, the recording sheet on which an image is printed is not spoiled by the toner and the carrier.

The entire exposure operation in accordance with the operation sequence in the second embodiment may be included in the initial operation of the printer.

The dot-area modulation patterns used in the entire exposure operation performed immediately after the photosensitive drum 20 starts may differ from those used in the entire exposure operation performed immediately before the photosensitive drum 20 is stopped. In addition, in the second embodiment, two types of dot-area modulation patterns (B and C) are used. However, a single type of dot-area modulation pattern (e.g., only the pattern B) and more than two types of dot-area modulation patterns may be used. In a case where a single type of dot-area modulation pattern is used, one of dot-area modulation patterns shown in FIGS. 20A, 20B and 20C can be selected as the single dot-area modulation pattern.

A description will now be given of a third embodiment of the present invention.

An electrophotographic apparatus according to the third embodiment has the structure shown in FIG. 5. In the trailing edge portion of an area which is entirely exposed immediately after the photosensitive drum 20 starts and in the leading edge portion of an area which is entirely exposed immediately before the photosensitive drum 20 is stopped, the level of the developing bias Vb switched from on to off and vise versa is sloped.

Figure 21:
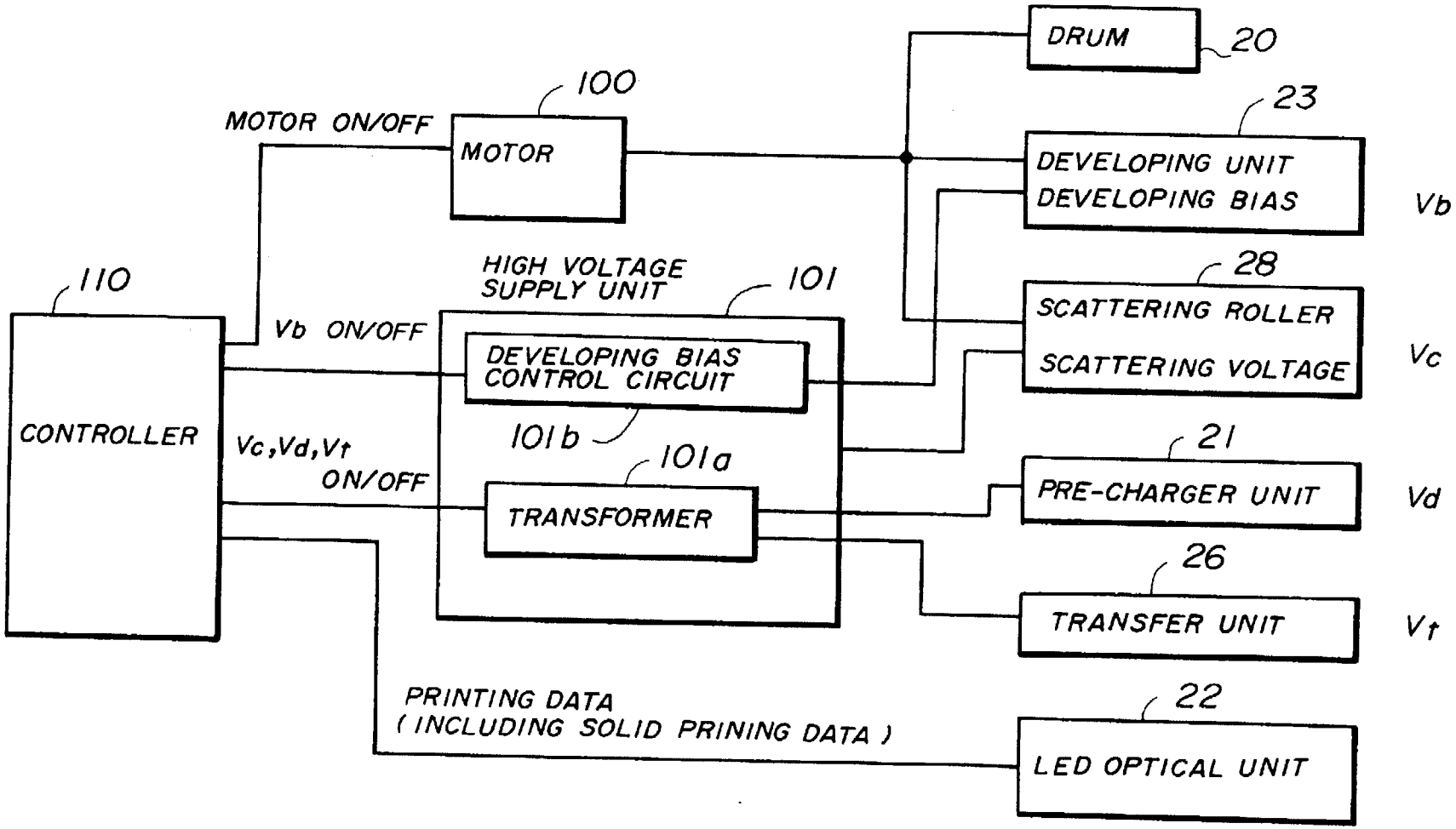
FIG. 21 is a block diagram illustrating a control system of the image forming apparatus according to a third embodiment of the present invention.

The control system in the third embodiment is formed as shown in FIG. 21. In FIG. 21, those parts which are the same as those shown in FIG. 6 are given the same reference numbers.

Referring to FIG. 21, the high-voltage power supply unit 101 differs from that in the above embodiments. The high-voltage power supply unit 101 in the third embodiment includes a developing bias control circuit **101*b*. The developing bias control circuit 101*b* modulates the developing bias Vb applied to the developing roller 24** at a predetermined time as will be described later.

Figure 22:
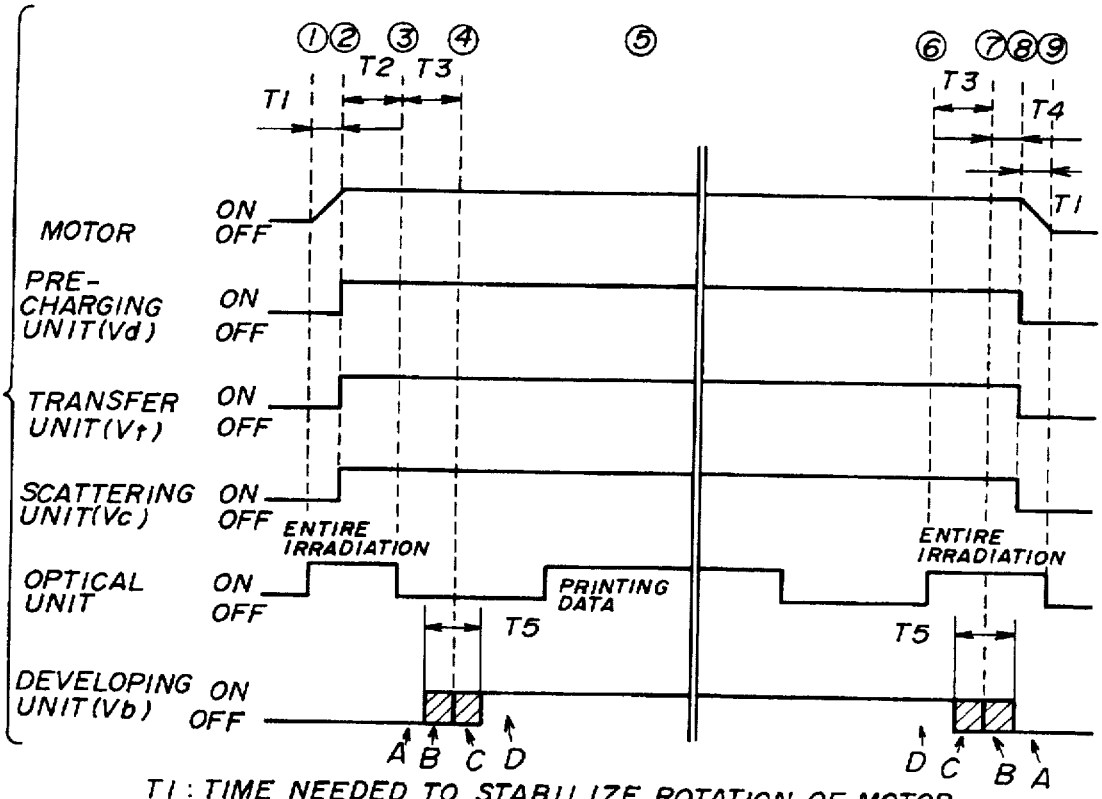
FIG. 22 is a timing chart illustrating an operation sequence of the control system shown in FIG. 21.

In the printer according to the third embodiment, a process is performed in accordance with an operation sequence shown in FIG. 22. The process is shown in FIGS. 23 and 24.

In the operation sequence shown in FIG. 22, operations immediately before and after a time ③, immediately before and after a time ④, immediately before and after a time ⑥ and immediately before and after a time ⑦ differ from corresponding operations shown in the above embodiments.

Figure 23:
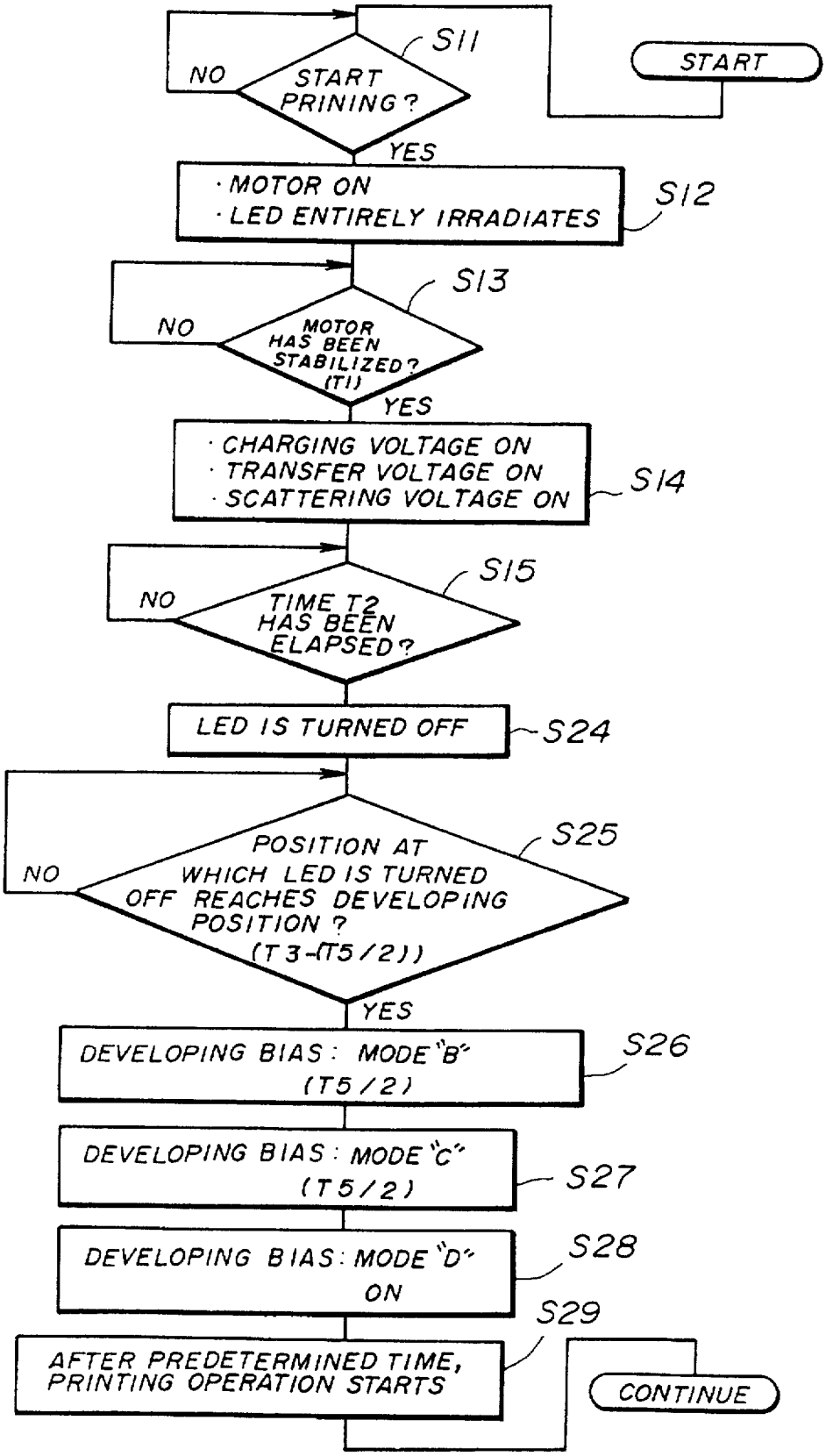
FIG. 23 is a flowchart illustrating a first part of a process corresponding to the operation sequence shown in FIG. 22.
Figure 24:
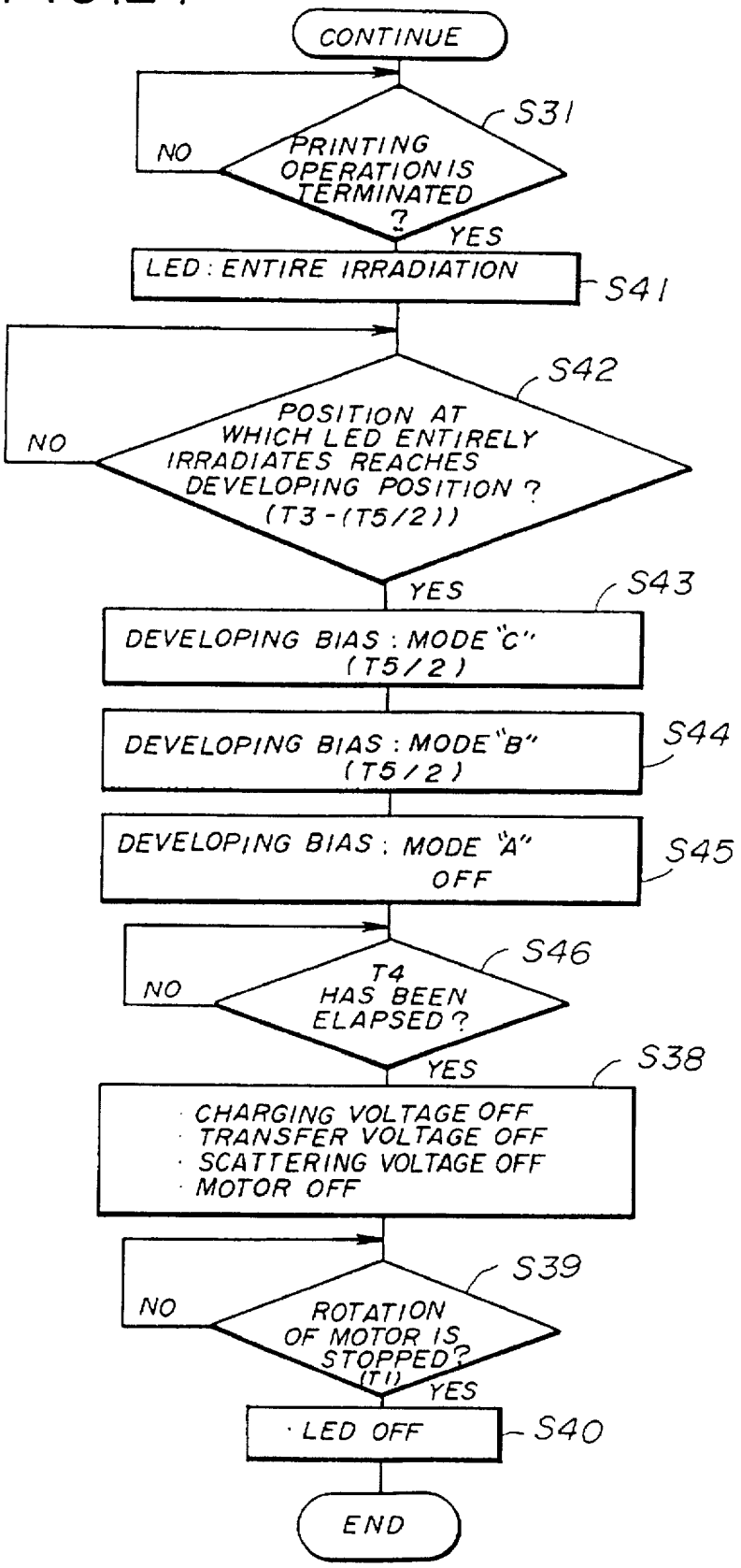
FIG. 24 is a flowchart illustrating a second part of the process corresponding to the operation sequence shown in FIG. 22.

Referring to FIG. 22 and FIG. 23, when a start instruction of the printing operation occurs (S11), the motor 100 starts to be driven and the LED optical unit 22 is activated to perform the entire exposure operation at a time ① (S12). In a state where the motor 100 is stably rotated (S13), the charging voltage Vd, the transfer voltage Vt and the scattering voltage Vc are simultaneously turned on at a time ②(S14).

After this, when a time T2 elapses from the time ① so that it is determined that the leading edge of an area which has been uniformly charged at a predetermined potential (e.g., −600 volts) reaches to the exposure position (S15), the LED optical unit is brought into an inactive state so that the LEDs are turned off (S24).

When it is determined that a portion in which the charged potential is suddenly changed on the photosensitive drum 20 reaches to the developing position, that is, when it is determined that a time (T3–T5/2) has been elapsed from the time ③(S25), the developing bias Vb is turned on. The operation mode of the developing unit 23 is changed from a mode "A" (Vb: turned off) through modes "B" and "C" to a mode "D" (Vb: in a printing state) so as to be increased at intervals (T5/2) (S26, S27 and S28). As a result, the developing bias Vb is sloped. The developing bias Vb is controlled in the respective modes as indicated in Table-2.

TABLE 2

| MODE | DEVELOPING BIAS Vb | NOTE |
|---|---|---|
| A | 0 volts | OFF |
| B | −200 volts | |
| C | −300 volts | |
| D | −450 volts | PRINT (ON) |

The time for which the developing bias Vb is controlled in the modes "B" and "C" so as to be sloped is set at a time, of 120 msec, corresponding to the width of the developing-nip area. As a result, in the portion in which the surface potential is suddenly changed on the photosensitive drum 20 (see FIG. 3), the developing bias Vb is sloped.

Since the developing bias Vb is sloped, the difference between the developing bias Vb and the suddenly changed surface potential of the photosensitive drum 20 is decreased in comparison with the conventional case. Thus, the amounts of toner and carrier adhering to the portion in which the surface potential is suddenly changed are decreased.

After this, in a period ⑤, the printing operation is carried out (S29). The process then proceeds to step S31 shown in FIG. 24. After it is determined that the printing operation has been terminated (S31), the LED optical unit 22 is turned on, at a time ⑥, so that the entire exposure operation starts (S41). When it is then determined that a portion in which the surface potential is suddenly changed on the photosensitive drum 20 by the entire exposure operation has reached the developing position, that is, when it is determined that a time (T3–T5/2) has been elapsed from the time ⑥(S42), the developing bias Vb applied to the developing unit 23 is turned off. In a process for turning off the developing bias Vb, the operation mode of the developing unit 23 is changed from the mode "D" through the modes "C" and "B" to the mode "A" so that the developing bias Vb is decreased at intervals (T5/2) (S43, S44 and S45). After this, the charging voltage Vd, the transfer voltage Vt, the scattering voltage Vc add the motor 100 are simultaneously turned off (S46 and S38). The LED optical unit 22 is brought into an inactive state at a time ⑨ at which the motor 100 is expected to stop (S39 and S40).

In the case of the developing bias control performed immediately after the printing operation, in the portion in which the surface potential is suddenly changed on the photosensitive drum 20, the developing bias Vb is sloped. As a result, the toner and the carrier is prevented from adhering to the portion in which the surface potential is suddenly changed.

The above process for controlling the developing bias Vb can be applied to the initial operation.

Immediately before and after the printing operation, the developing bias Vb may be controlled using the different developing bias tables (see Table-2). In the third embodiment, to slope the developing bias, two types of operation modes "B" and "C" are used. However, a single (e.g., only the mode "B") and three or more types of operation modes may be used. The developing bias can be continuously varied in an analog manner.

According to the third embodiment, in the trailing edge portion of an area in which the photosensitive drum 20 is entirely exposed immediately after the photosensitive drum 20 starts and in the leading edge portion of an area in which the photosensitive drum 20 is exposed immediately before the photosensitive drum 20 is stopped, the developing bias Vb is controlled so as to be sloped. Thus, the amounts of toner and carrier adhering to the trailing edge portion and the leading edge portion of the areas can be decreased. As a result, an image having a high quality can be formed on a recording sheet.

The present invention is not limited to the aforementioned embodiments, and other variations and modifications may be made without departing from the scope of the claimed invention.

For example, the following modifications can be made.

In cases of the initial operation and the printing operation, or in cases of start and stop of the photosensitive drum 20, different modulation methods (e.g., a surface potential modulation and a developing bias modulation) can be used.

In one of the cases of the initial operation and the printing operation, or in one of cases of the start and stop of the photosensitive drum 20, the present invention can be applied.

The present invention can be applied to an electrophotographic apparatus having a cleaner unit (not the cleanerless type). In this case, since the amount of the residual toner can be reduced, the toner is efficiently used in the printing operation. In addition, the amount of toner scattered in the housing is reduced, so that recording sheets in the housing and the inside of the housing are not soiled by the toner.

A laser optical system, a liquid crystal shatter optical system, an EL (Electroluminescence) optical system or the like can be substituted for the LED optical unit 22.

What is claimed is:

1. An image forming apparatus in which an electrophotographic process including a uniform charging step, an exposure step, a developing step and a transfer step is performed on a photosensitive body which is driven so that an image is formed on a recording medium, said image forming apparatus comprising:

discharging means for discharging the photosensitive body which has been uniformly charged;

discharging control means for controlling said discharging means before the photosensitive body is stopped so that a potential distribution is obtained in an area having a predetermined width starting from a position at which said discharging means starts to discharge said photosensitive body, said potential distribution being a gradual reduction between a first potential obtained by charging said photosensitive body and a second potential;

stop control means for performing an operation for stopping driving said photosensitive body in a state where a developing position enters the area having the potential distribution, the developing position being a position at which the developing step is performed on said photosensitive body; and bias control means for turning off a developing bias used in the developing step in the state where the developing position enters the area having the potential distribution.

2. The image forming apparatus as claimed in claim 1, wherein said discharging control means controls said discharging means so that the potential distribution in which a surface potential is decreased from the first potential to the second potential is obtained.

3. The image forming apparatus as claimed in claim 1, wherein said discharging control means has means for controlling said discharging means in accordance with dot patterns arranged such that a dotted area to be discharged is increased on the area in which the potential distribution is to be formed.

4. An image forming apparatus in which an electrophotographic process including a uniform charging step, an exposure step, a developing step and a transfer step is performed on a photosensitive body which is driven so that an image is formed on a recording medium, said image forming apparatus comprising:

discharging means for discharging the photosensitive body which has been uniformly charged;

discharging control means for controlling said discharging means so that a second potential is obtained, from a start of driving said photosensitive body, as a potential at which said photosensitive body is discharged and so that a potential distribution is obtained in an area having a predetermined width at an end of discharging the photosensitive body, said potential distribution being a gradual reduction between a first potential obtained by charging said photosensitive body and the second potential; and bias control means for turning on a developing bias used in the developing step in a state where a developing position enters the area having the potential distribution after said photosensitive body starts to be driven, the developing position being a position at which the developing step is performed on said photosensitive body.

5. The image forming apparatus as claimed in claim 4, wherein said discharging control means controls said discharging means so that the potential distribution in which a surface potential is increased from the second potential to the first potential is obtained.

6. The image forming apparatus as claimed in claim 4, wherein said discharging control means has means for controlling said discharging means in accordance with dot patterns arranged such that a dotted area to be discharged is decreased on the area in which the potential distribution is to be formed.

7. The image forming apparatus as claimed in claim 1 or 4, wherein said discharging means includes an optical system having a light source used in the exposure step.

8. The image forming apparatus as claimed in claim 7, wherein said discharging control means has means for controlling an irradiation time for which said light source corresponding to each dot irradiates said photosensitive body.

9. The image forming apparatus as claimed in claim 7, wherein said discharging control means has means for controlling an amount of light from said light source corresponding to each dot.

10. The image forming apparatus as claimed in claim 1 or 4, wherein said discharging control means has means for controlling said discharging means in accordance with a predetermined pattern indicating a dotted area to be discharged on the area in which the potential distribution is to be formed.

11. The image forming apparatus as claimed in claim 1 or 4, wherein the area in which the potential distribution is to be formed corresponds to an area falling within a range between half of a developing-nip area and twice as large as the developing-nip area, the developing-nip area being an area on which developer in a developing unit used in the developing step is substantially in contact with said photosensitive body.

12. The image forming apparatus as claimed in claim 11, wherein said area in which the potential distribution is to be formed corresponds to the developing-nip area.

13. An image forming apparatus in which an electrophotographic process including a uniformly charging step, an exposure step, a developing step and a transfer step is performed on a photosensitive body which is driven so that an image is formed on a recording medium, said image forming apparatus comprising:

discharging means for discharging said photosensitive body which has been uniformly charged;

first discharging control means for controlling said discharging means so that a second potential is obtained, from a start of driving said photosensitive body, as a potential at which said photosensitive body is discharged and so that a potential distribution is obtained in a first area having a predetermined width at an end of discharging the photosensitive body, said potential distribution being between a first potential obtained by charging said photosensitive body and the second potential;

first bias control means for turning on a developing bias used in the developing step in a state where a developing position enters the first area having the potential distribution after said photosensitive body starts to be driven, the developing position being a position at which the developing step is performed on said photosensitive body;

second discharging control means for controlling said discharging means before the photosensitive body is stopped so that a potential distribution is obtained in a second area having a predetermined width starting from a position at which said discharging means starts to discharge said photosensitive body, said potential distribution being between the first potential and the second potential;

stop control means for performing an operation for stopping driving said photosensitive body in a state where the developing position enters the second area; and second bias control means for turning off the developing bias in the state where the developing position enters the second area.

14. The image forming apparatus as claimed in claim 13, wherein said first discharging control means controls said discharging means so that the potential distribution in which a surface potential is increased from the second potential to the first potential is obtained, and wherein said second discharging control means controls said discharging means so that the potential distribution in which the surface potential is decreased from the first potential to the second potential is obtained.

15. The image forming apparatus as claimed in claim 13, wherein said discharging means includes an optical system having a light source used in the exposure step.

16. The image forming apparatus as claimed in claim 15, wherein at least one of said first discharging control means and said second discharging control means has means for controlling an irradiation time for which said light source corresponding to each dot irradiates said photosensitive body.

17. The image forming apparatus as claimed in claim 15, wherein at least one of said first discharging control means and said second discharging control means has means for controlling an amount of light from said light source corresponding to each dot.

18. The image forming apparatus as claimed in claim 13, wherein at least one of said first discharging control means and said second discharging control means has means for controlling said discharging means in accordance with a predetermined pattern indicating a dotted area to be discharged on the first area and/or the second area in which the potential distribution is to be formed.

19. The image forming apparatus as claimed in claim 13, wherein said first discharging control means has means for controlling said discharging means in accordance with dot patterns arranged such that a dotted area to be discharged is decreased on the first area in which the potential distribution is to be formed.

20. The image forming apparatus as claimed in claim 13, wherein said second discharging control means has means for controlling said discharging means in accordance with dot patterns arranged such that a dotted area to be discharged is increased on the second area in which the potential distribution is to be formed.

21. The image forming apparatus as claimed in claim 13, wherein each of the first area and second area in which the potential distribution is to be formed corresponds to an area falling within a range between half of a developing-nip area and twice as large as the developing-nip area, the developing-nip area being an area on which developer in a developing unit used in the developing step is substantially in contact with said photosensitive body.

22. The image forming apparatus as claimed in claim 21, wherein each of the first area and the second area in which the potential distribution is to be formed corresponds to the developing-nip area.

23. An image forming apparatus in which an electrophotographic process including a uniform charging step, an exposure step, a developing step and a transfer step is performed on a photosensitive body which is driven so that an image is formed on a recording medium, said image forming apparatus comprising:

discharging means for discharging said photosensitive body which has been uniformly charged;

discharging control means for activating said discharging means so that said photosensitive body is discharged at a predetermined potential before said photosensitive body is stopped;

stop control means for performing an operation for stopping driving said photosensitive body in a state where a developing position at which the developing step is performed enters an area including a boundary between a leading edge of a portion discharged by said discharging means and a portion uniformly charged in the uniform charging step; and bias control means for controlling a developing bias used in the developing step so that the developing bias is varied from a predetermined potential to an off potential in the state where the developing position enters the area including the boundary between the leading edge of the discharged portion and the uniformly charged portion, the off potential being a potential which is obtained when the developing bias is turned off.

24. An image forming apparatus in which an electrophotographic process including a uniform charging step, an exposure step, a developing step and a transfer step is performed on a photosensitive body which is driven so that an image is formed on a recording medium, said image forming apparatus comprising:

discharging means for discharging said photosensitive body which has been uniformly charged;

discharging control means for controlling said discharging means so that a predetermined potential is obtained, from a start of driving said photosensitive body, as a potential at which said photosensitive body is discharged and so that said discharging means is brought into an inactive state at a predetermined time; and bias control means for controlling a developing bias used in the developing step so that the developing bias is increased from an off potential a predetermined potential, after said photosensitive body starts to be driven, in a state where a developing position at which the developing step is performed enters an area including a boundary between a trailing edge of a portion discharged by said discharging means and a portion uniformly charged in the uniformly charging step.

25. The image forming apparatus as claimed in claim 23 or 24, wherein the area including the boundary between the discharged portion and the uniformly charged portion corresponds to an area falling within a range between half of a developing-nip area and twice as large as the developing-nip area, the developing-nip area being an area on which developer in a developing unit used in the developing step is substantially in contact with said photosensitive body.

26. The image forming apparatus as claimed in claim 25, wherein the area including the boundary between the discharged portion and the uniformly charged portion corresponds to the developing-nip area.

27. An image forming apparatus in which an electrophotographic process including a uniform charging step, an exposure step, a developing step and a transfer step is performed on a photosensitive body which is driven so that an image is formed on a recording medium, said image forming apparatus comprising:

discharging means for discharging said photosensitive body which has been uniformly charged;

first discharging control means for controlling said discharging means so that a predetermined potential is obtained, from a start of driving said photosensitive body, as a potential at which said photosensitive body is discharged and so that said discharging means is brought into an inactive state at predetermined time;

first bias control means for controlling a developing bias used in the developing step so that the developing bias is increased from an off potential to a predetermined potential, after said photosensitive body starts to be driven, in a state where a developing position at which the developing step is performed enters a first area including a boundary between a trailing edge of a portion discharged by said discharging means and a portion uniformly charged in the uniformly charging step;

second discharging control means for activating said discharging means so that said photosensitive body is discharged at a predetermined potential before said photosensitive body is stopped;

stop control means for performing an operation for stopping driving said photosensitive body in a state where the developing position enters a second area including a boundary between a leading edge of a portion discharged by said discharging means and a portion uniformly charged in the uniform charging step; and bias control means for controlling a developing bias used in the developing step so that the developing bias is varied from a predetermined potential to an off potential in the state where the developing position enters the second area, the off potential being a potential which is obtained when the developing bias is turned off.

28. The image forming apparatus as claimed in claim 27, wherein each of said first area and the second area corresponds to an area falling within a range between half of a developing-nip area and twice as large as the developing-nip area, the developing-nip area being an area on which developer in a developing unit used in the developing step is substantially in contact with said photosensitive body.

29. The image forming apparatus as claimed in claim 28, wherein each of said first area and the second area corresponds to the developing-nip area.

30. The image forming apparatus as claimed in any one of claim 1, 2, 13, 23, 24 or 27, wherein a width of an area which is to be discharged on said photosensitive body is equal to or greater than a maximum width of the recording medium which is to be supplied to said image forming apparatus.

* * * * *